US011634292B2

(12) United States Patent
Machii et al.

(10) Patent No.: US 11,634,292 B2
(45) Date of Patent: Apr. 25, 2023

(54) SHEET CONVEYANCE APPARATUS AND IMAGE FORMING APPARATUS

(71) Applicant: CANON KABUSHIKI KAISHA, Tokyo (JP)

(72) Inventors: Emi Machii, Shizuoka (JP); Takafumi Suzuki, Shizuoka (JP); Seiji Obata, Shizuoka (JP); Koichi Sekimizu, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/377,564

(22) Filed: Jul. 16, 2021

(65) Prior Publication Data

US 2022/0017319 A1 Jan. 20, 2022

(30) Foreign Application Priority Data

Jul. 20, 2020 (JP) ..... JP2020-123703

(51) Int. Cl.
*B65H 7/14* (2006.01)
*B65H 5/06* (2006.01)

(52) U.S. Cl.
CPC ..... *B65H 7/14* (2013.01); *B65H 5/062* (2013.01)

(58) Field of Classification Search
None
See application file for complete search history.

(56) References Cited

U.S. PATENT DOCUMENTS 3,901,607 A * 8/1975 Kingsland ..... B65H 7/14 356/429
10,155,635 B2 12/2018 Suzuki
2003/0031476 A1* 2/2003 Takeuchi ..... G03G 15/65 399/16

(Continued)

FOREIGN PATENT DOCUMENTS

EP 1510484 A1 * 3/2005 ..... B65H 7/14
JP H0859025 A 3/1996

(Continued)

OTHER PUBLICATIONS

Machine Translation of Ueoka, WO 2015097854 A1, 2015 (Year: 2015).*

*Primary Examiner* — Jennifer Bahls
(74) *Attorney, Agent, or Firm* — Rossi, Kimms & McDowell LLP

(57) ABSTRACT

A sheet conveyance apparatus includes a conveyance unit configured to convey a sheet, a guide member disposed to define a conveyance path, a light-emitting element, a light-receiving element configured to output a detection signal that changes in accordance with an amount of received light, a first light-passing portion disposed to define an optical path from the light-emitting element to the conveyance path, and a second light-passing portion disposed to define an optical path from the conveyance path to the light-receiving element. The light-receiving element is configured such that the detection signal changes in accordance with whether or not a sheet is present in the conveyance path. Reflectance of each of the first light-passing portion and the second light-passing portion to the light emitted from the light-emitting element is higher than reflectance of the guide member to the light emitted from the light-emitting element.

19 Claims, 17 Drawing Sheets

(56) References Cited

U.S. PATENT DOCUMENTS

| | | | | |
|---|---|---|---|---|
| 2016/0090255 | A1* | 3/2016 | Higuchi | B65H 1/02 271/265.01 |
| 2018/0081314 | A1* | 3/2018 | Suzuki | G03G 15/5004 |
| 2018/0118488 | A1* | 5/2018 | Suzuki | B65H 7/14 |

FOREIGN PATENT DOCUMENTS

| | | | | |
|---|---|---|---|---|
| JP | 2004309432 | A | 11/2004 | |
| JP | 2014001069 | A | 1/2014 | |
| JP | 2018047967 | A | 3/2018 | |
| WO | WO-2015097854 | A1 * | 7/2015 | B65H 7/14 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus that conveys a sheet, and an image forming apparatus that forms an image on a sheet.

Description of the Related Art

An image forming apparatus such as a printer, a copier, or a multifunctional printer includes a sheet detection mechanism for detecting a sheet that is provided in a sheet conveyance path for controlling conveyance of a sheet that is used as a recording material or as a document. As the image forming apparatus has become faster, a sheet detection mechanism of an optical type that detects the presence or absence of a sheet by using light has been increasingly used due to its quick response.

In addition, an image forming apparatus of an electrophotographic system includes a fixing unit of a thermal fixation system that heats a toner image transferred onto a sheet to fix the toner image to the sheet. In the case of disposing a sheet detection mechanism of an optical type in the vicinity of the fixing unit, if water vapor generated from the sheet condenses on a member in an optical path or deterioration of a light-emitting portion progresses due to high temperature to reduce the amount of light emission, the amount of light incident on a light-receiving portion decreases, and the detection accuracy may deteriorate. Japanese Patent Laid-Open No. 2018-47967 discloses disposing an optical sensor in the vicinity of a fixing unit and cooling a light-emitting portion and a light-receiving portion of the optical sensor by blowing cooling air to the light-emitting portion and the light-receiving portion to suppress dew condensation and deterioration of the light-emitting portion.

To accurately detect the presence or absence of a sheet by a sheet detection mechanism of an optical type, it is necessary that the amount of light incident on the light-receiving portion changes in accordance with the presence or absence of the sheet and a detection signal from the light-receiving portion changes beyond a preset threshold value. However, in some cases, the sheet is detected under disadvantageous conditions other than the dew condensation and deterioration of the light-emitting portion described above, such as deterioration of the light-emitting portion derived from increase in the accumulated light emission time or presence of stray light. In such a case, conventionally, there is a possibility that the difference in the amount of light incident on the light-receiving portion between a state in which a sheet is present and a state in which no sheet is present becomes small and thus the detection accuracy is lowered.

SUMMARY OF THE INVENTION

The present invention provides a sheet conveyance apparatus and an image forming apparatus that can stably detect a presence or absence of a sheet with high detection accuracy.

According to an aspect of the invention, a sheet conveyance apparatus includes a conveyance unit configured to convey a sheet, a guide member disposed to define a conveyance path through which a sheet is conveyed, a light-emitting element configured to emit light, a light-receiving element configured to output a detection signal that changes in accordance with an amount of received light, a first light-passing portion disposed to define an optical path from the light-emitting element to the conveyance path, and a second light-passing portion disposed to define an optical path from the conveyance path to the light-receiving element, wherein the light-receiving element is configured such that the detection signal changes in accordance with whether or not a sheet is present in the conveyance path, and wherein reflectance of each of the first light-passing portion and the second light-passing portion to the light emitted from the light-emitting element is higher than reflectance of the guide member to the light emitted from the light-emitting element.

Further features of the present invention will become apparent from the following description of exemplary embodiments with reference to the attached drawings.

DESCRIPTION OF THE EMBODIMENTS

Embodiments of the present disclosure will be described below with reference to drawings.

First Embodiment

A sheet detection mechanism and an image forming apparatus according to a first embodiment will be described below. First, an overall configuration of an image forming apparatus 1 will be described below with the operation thereof in image formation with reference to FIG. 1.

Figure 1:
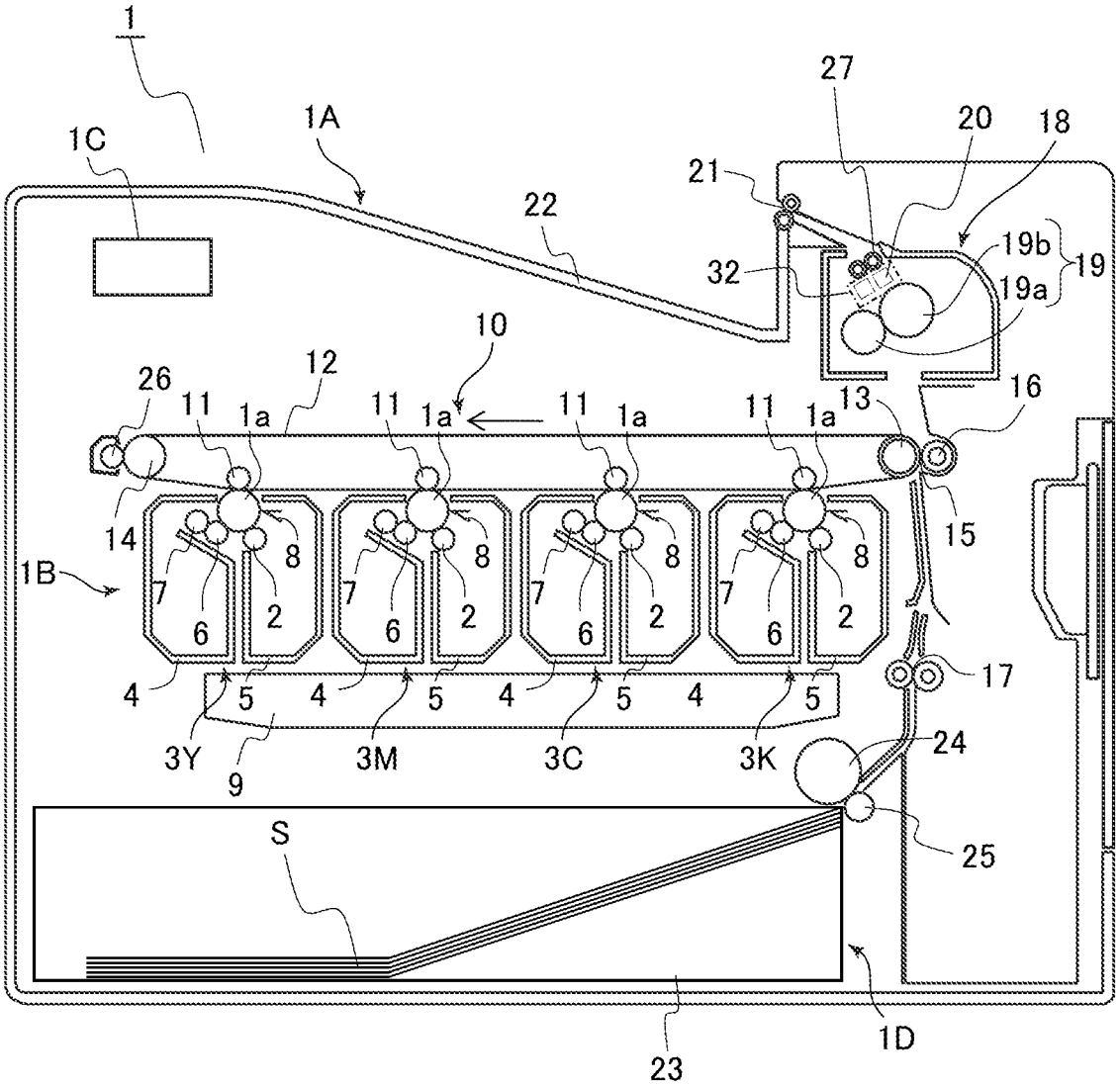
FIG. 1 is a schematic view of an image forming apparatus according to a first embodiment.

The image forming apparatus 1 illustrated in FIG. 1 is an electrophotographic image forming apparatus of an intermediate transfer tandem type that forms an image by transferring toner images of four colors of yellow Y, magenta M, cyan C, and black K onto an intermediate transfer belt through primary transfer and then transferring the toner images onto a sheet through secondary transfer. The image forming apparatus 1 includes an image forming portion 1B that forms a toner image on a sheet, a sheet feeding portion 1D that supplies a sheet to the image forming portion 1B, and a fixing unit 18 that fixes the toner image to the sheet.

The sheet feeding portion 1D includes a cassette 23, a feed roller 24, and a separation roller 25. The cassette 23 is a sheet supporting portion that supports a sheet S to be fed, and is attachable to and detachable from a body of the image forming apparatus 1. The body of the image forming apparatus 1 is a casing including a frame member and an exterior, and will be hereinafter referred to as an apparatus body 1A. To be noted, as the sheet S serving as a recording material, a wide variety of sheets of different materials having different sizes can be used. Examples of the usable sheets include paper sheets such as plain paper sheets and cardboards, plastic films, cloths, surface-treated sheet materials such as coated paper sheets, and sheet materials of irregular shapes such as envelops and index sheets.

The feed roller 24 is a feeding member that is rotated by a drive from an unillustrated drive unit fixed to the apparatus body 1A, and abuts the uppermost sheet among sheets S supported in the cassette 23 to feed the uppermost sheet S to a conveyance path. For example, the drive unit includes a drive mechanism such as a gear train held by a frame constituting the frame member of the apparatus body 1A, and a drive source such as a motor that supplies a driving force to the drive mechanism. The separation roller 25 abuts the feed roller 24 to form a separation nip therebetween, and applies a frictional force to the sheet S in the separation nip to separate other sheets S from the uppermost sheet S conveyed by the feed roller 24 to suppress simultaneous conveyance of multiple sheets S.

An image forming portion 1B includes a laser scanner unit 9, an intermediate transfer unit 10, and process cartridges 3Y, 3M, 3C, and 3K. The process cartridges 3Y, 3M, 3C, and 3K have the same configuration except for forming toner images of different colors. That is, the process cartridges 3Y, 3M, 3C, and 3K respectively form toner images by using toner of yellow Y, magenta M, cyan C, and black K. The process cartridges 3Y, 3M, 3C, and 3K are attachable to and detachable from the apparatus body 1A, and each cartridge is constituted by a photoconductor unit 5 and a developing unit 4.

The photoconductor units 5 each include a photosensitive drum 1*a* that is a photosensitive member serving as an image bearing member formed in a drum shape, a charging roller 2 serving as a charging portion, a cleaning blade 8 serving as a cleaning portion, and so forth. In addition, the developing units 4 serving as developing portions each include a developing roller 6 serving as a developer bearing member, a toner application roller 7, and so forth.

An intermediate transfer unit 10 includes an intermediate transfer belt 12 serving as an intermediate transfer member, four primary transfer rollers 11, a secondary transfer roller 16, a secondary transfer counter roller 13, a cleaning unit 26, and a tension roller 14. The intermediate transfer belt 12 is an endless tubular belt stretched by the secondary transfer counter roller 13 and the tension roller 14, and rotates in a counterclockwise direction in FIG. 1 by being driven by the secondary transfer counter roller 13. A transfer nip portion serving as a secondary transfer portion is formed between the secondary transfer counter roller 13 and the secondary transfer roller 16 opposing each other with the intermediate transfer belt 12 therebetween.

A fixing unit 18 is configured as a thermal fixation system including a fixing roller pair 19 serving as a rotary member pair that nips and conveys a sheet S, and a heating portion that heats a toner image on the sheet S. In the present embodiment, the fixing roller pair 19 includes a heating roller 19*a* that abuts an image surface of the sheet S, which is a surface onto which the toner image has been transferred in the secondary transfer portion, and a pressurizing roller 19*b* that comes into pressure contact with the heating roller 19*a*. The sheet S is nipped and conveyed by the nip portion of the fixing roller pair 19 serving as a fixing nip. To be noted, for example, a guide member fitted in a tubular film may be used in place of the heating roller 19*a* and/or the pressurizing roller 19*b*. As the heating portion, for example, a halogen lamp, a heater in which a resistance heating element is disposed on a ceramic substrate, an induction heating device that heats a conductive layer provided in a heating roller or a film by electromagnetic induction, or the like can be used.

In the case where the image forming apparatus 1 performs an image forming operation, when a controller 1C included in the apparatus body 1A outputs a print signal, sheets S accommodated in the cassette 23 are fed one by one by the feed roller 24, and are conveyed to a registration roller pair 17. The skew and timing of the sheet S is corrected by the registration roller pair 17, and then the sheet S is delivered out to the secondary transfer portion of the image forming portion 1B. To be noted, the controller 1C includes at least one processor and a memory, and controls the operation of the image forming apparatus by the processor loading a control program from the memory and executing the control program. The control program executed by the controller 1C defines a method for determining whether or not a sheet is present on the basis of a detection signal from a sheet detection mechanism 32 that will be described later, in addition to the procedure of the image forming operation.

In the image forming portion 1B, first the surface of each of the photosensitive drums 1*a* is uniformly charged to a predetermined polarity by a corresponding one of the charging rollers 2. In the present embodiment, the predetermined polarity is a negative polarity. Next, the laser scanner unit 9 emits, from an unillustrated light source, laser light modulated in accordance with signals obtained by decomposing image information to be printed into component images of respective colors, and thus exposes the surface of the photosensitive drums 1*a*. As a result of this, electrostatic latent images corresponding to component images of respective colors are formed on the surface of the respective photosensitive drums 1*a*. Then, the electrostatic latent images are developed by attaching toner serving as developer to the electrostatic latent images by the developing unit 4, and thus a monochromatic toner image is formed on the surface of each of the photosensitive drums 1*a*.

The toner images formed on the surface of the photosensitive drums 1*a* are transferred onto the intermediate transfer belt 12 through primary transfer so as to form a full-color toner image, by applying a bias voltage of an opposite polarity to the normal charging polarity of toner to the primary transfer rollers 11 opposing the photosensitive drums 1*a* with the intermediate transfer belt 12 therebetween. In the present embodiment, the opposite polarity to the normal charging polarity of toner is a positive polarity. The toner image formed on the intermediate transfer belt 12 reaches the secondary transfer portion as a result of the rotation of the intermediate transfer belt 12. Then, in the secondary transfer portion, a bias voltage of an opposite polarity to the normal charging polarity of toner is applied to the secondary transfer roller 16, and thus the toner image is transferred onto the sheet S through secondary transfer.

The sheet S onto which the toner image formed by the image forming portion 1B has been transferred in the secondary transfer portion is conveyed to the fixing unit 18. The fixing unit 18 heats and pressurizes the toner image on the sheet S while nipping and conveying the sheet S by the fixing roller pair 19, and thus fixes the toner image to the sheet S. The sheet S having passed through the fixing unit 18 is further conveyed by a conveyance roller pair 27, and is discharged onto a discharge tray 22 by a discharge roller pair 21.

The feed roller 24 and the registration roller pair 17 that are arranged along the conveyance path of the sheet S in the image forming apparatus 1 described above serve as examples of a conveyance unit that conveys the sheet S. Similarly, the secondary transfer roller 16, the secondary transfer counter roller 13, the fixing roller pair 19, the conveyance roller pair 27, and the discharge roller pair 21 arranged along the conveyance path of the sheet S in the image forming apparatus 1 serve as other examples of the conveyance unit that conveys the sheet S.

To be noted, although the image forming portion 1B that is an electrophotographic unit of an intermediate transfer type has been described as an example of an image forming portion in the present embodiment, an electrophotographic unit of a direct transfer type that transfers a toner image formed on an image bearing member onto a recording material without using an intermediate transfer member may be used. In addition, the image forming portion is not limited to an electrophotographic system, and for example, an image forming portion of an inkjet system or an offset printing system may be used.

Sheet Detection Mechanism

Next, a sheet detection mechanism 32 of an optical type that detects the presence or absence of a sheet in a conveyance path in which the sheet is conveyed in the image forming apparatus 1 will be described. As illustrated in FIG. 1, the sheet detection mechanism 32 of the present embodiment is disposed downstream of the fixing roller pair 19 and upstream of the conveyance roller pair 27 in the conveyance direction of the sheet S, and outputs a detection signal indicating the presence or absence of the sheet S being delivered out from the fixing roller pair 19. In addition, the detection signal of the sheet detection mechanism 32 is transmitted to the controller 1C.

The controller 1C performs notification of a jam and conveyance control of the sheet S on the basis of the detection signal received from the sheet detection mechanism 32. For example, in the case where the sheet detection mechanism 32 does not output a detection signal indicating the presence of the sheet S even after the elapse of a predetermined time since the start of the image forming operation, the controller 1C can determine that a jam or conveyance failure of the sheet S has occurred at a position before the fixing unit 18. In addition, for example, the controller 1C determines when to start and stop driving the discharge roller pair 21 by using time points at which the detection result of the sheet detection mechanism 32 has been switched as time points at which the leading end and trailing end of the sheet S have respectively passed a predetermined position in the conveyance path. The leading end and trailing end of the sheet S are respectively a downstream end an upstream end in the conveyance direction. Therefore, it is necessary that the detection signal of the sheet detection mechanism 32 correctly reflects the presence or absence of the sheet S for the image forming apparatus 1 to exert its full potential.

Basic Configuration of Sheet Detection Mechanism

The basic configuration of the sheet detection mechanism 32 will be described. In the description below, a movement direction of a sheet passing the sheet detection mechanism 32 will be referred to as a "conveyance direction Z". A direction along the sheet surface perpendicular to the conveyance direction Z will be referred to as a "sheet width direction X". A direction perpendicular to the sheet width direction X and the conveyance direction Z, that is, a normal direction of the sheet surface at a position opposing the sheet detection mechanism 32 will be referred to as a "thickness direction Y" of the sheet. In the present embodiment, the sheet width direction X is substantially the same as the rotation axis direction of the heating roller 19*a* and the pressurizing roller 19*b* in the fixing unit 18, that is, the longitudinal direction of the fixing nip and the main scanning direction in image formation. The conveyance direction Z is substantially the same as a direction in which a sheet is delivered out from the fixing nip, that is, the short side direction of the fixing nip. In addition, the shapes of members related to the sheet detection mechanism 32 and the positional relationship between the members related to the sheet detection mechanism 32 will be described on the basis of a state in which the members are mounted as part of the image forming apparatus 1.

Figure 2A:
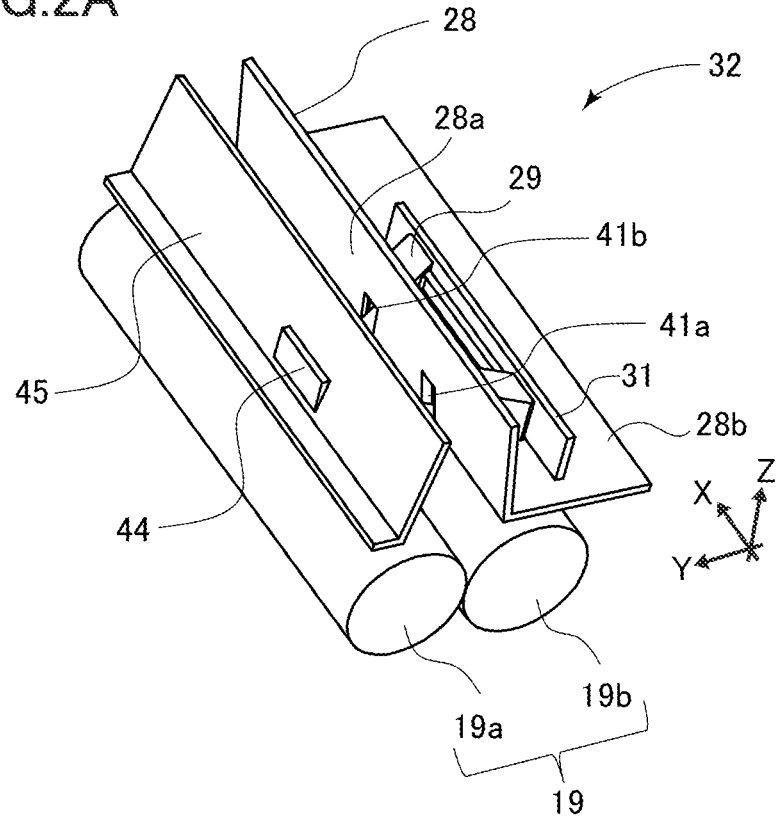
FIGS. 2A and 2B are each a perspective view of a sheet detection mechanism according to the first embodiment
Figure 2B:
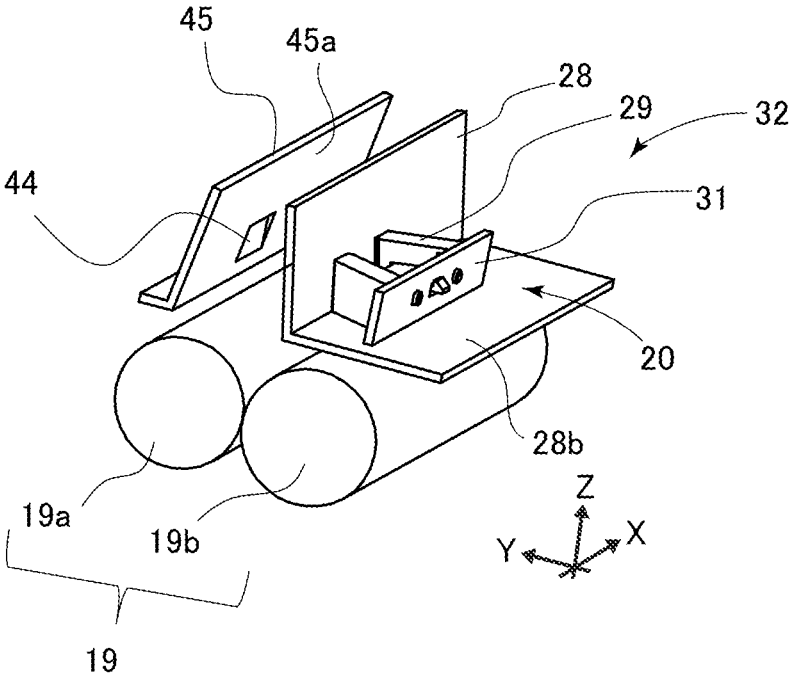
Figure 3A:
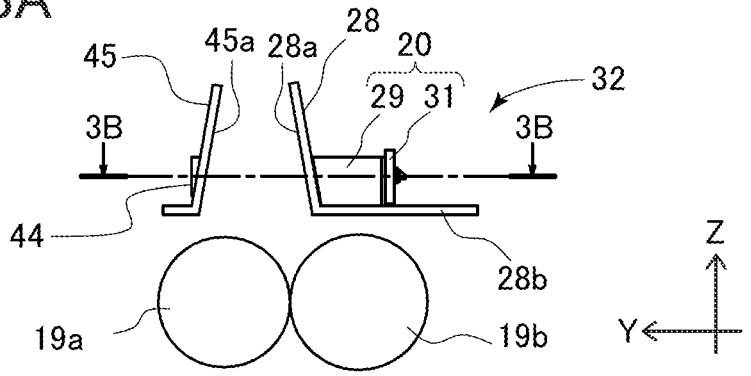
FIG. 3A is a side view of the sheet detection mechanism according to the first embodiment.
Figure 3B:
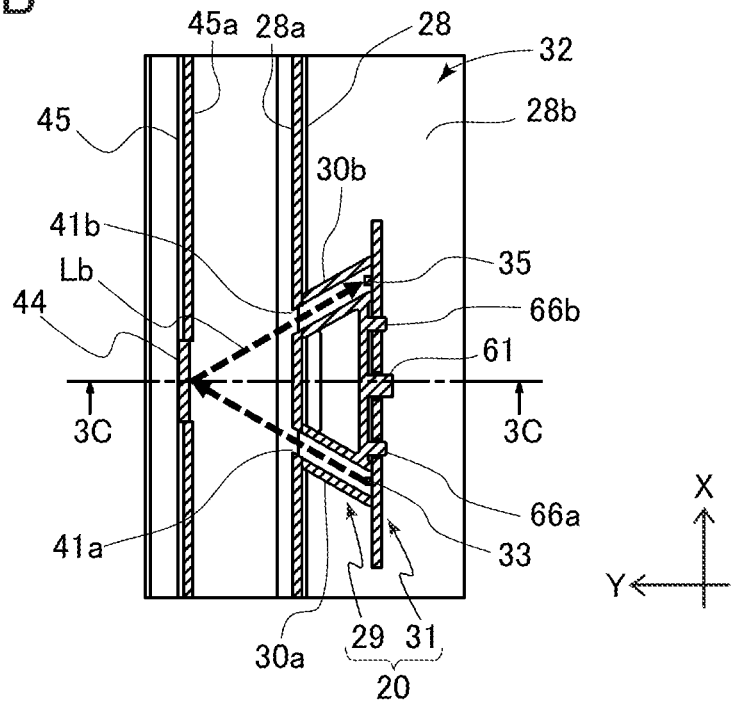
FIGS. 3B and 3C are each a section view of the sheet detection mechanism according to the first embodiment.
Figure 3C:
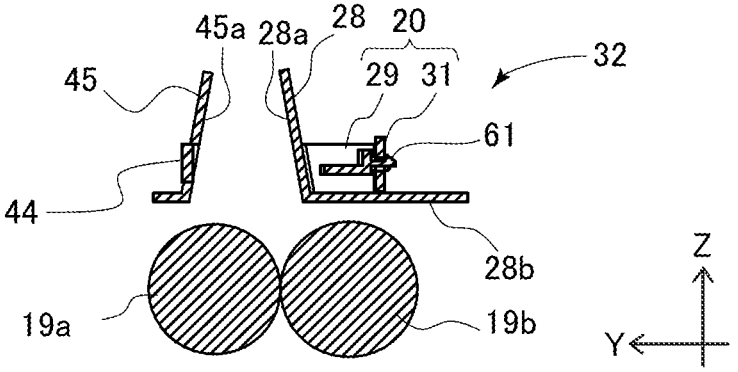

FIGS. 2A and 2B are each a perspective view of the sheet detection mechanism 32. FIG. 3A is a side view of the sheet detection mechanism 32 as viewed in the sheet width direction X. FIG. 3B is a section view of the sheet detection mechanism 32 taken along a virtual plane along one of optical paths in the sheet detection mechanism 32 indicated by a line 3B-3B in FIG. 3A, which is perpendicular to the conveyance direction Z in the present embodiment. FIG. 3C is a section view of the sheet detection mechanism 32 taken along a virtual plane perpendicular to the sheet width direction X indicated by a line 3C-3C in FIG. 3B as viewed in the sheet width direction X.

As illustrated in FIGS. 2A to 3C, the sheet detection mechanism 32 includes a sensor unit 20 and a reflection plate 44 that are attached to a guide unit defining a conveyance path downstream of the fixing roller pair 19 in the conveyance direction Z.

The guide unit includes a first conveyance guide 28 that guides a first surface of the sheet, and a second conveyance guide 45 that opposes the first conveyance guide 28 with the conveyance path serving as a space for the sheet to move through therebetween and guides a second surface of the sheet. The first conveyance guide 28 and the second conveyance guide 45 respectively have guide surfaces 28*a* and 45*a* each extending in the sheet width direction X and the conveyance direction Z, and the conveyance path is defined between the guide surface 28*a* and 45*a* opposing each other. To be noted, the guide surfaces 28*a* and 45*a* are not limited to flat surfaces. For example, a plurality of ribs may be formed on the guide surfaces 28*a* and 45*a* along the conveyance direction Z, or lattice-shaped holes or slits may be defined in the guide surfaces 28*a* and 45*a* as ventilation holes.

The sensor unit 20 includes a sensor substrate 31 serving as a sensor board and a fixing stage 29, and is attached to the first conveyance guide 28. Specifically, the fixing stage 29 is fixed to a surface of the first conveyance guide 28 opposite to the guide surface 28*a*, that is, on the other side of the first conveyance guide 28 as viewed from the conveyance path such that a projection area of the fixing stage 29 is within the first conveyance guide 28, and the sensor substrate 31 is attached to the fixing stage 29.

Figure 4:
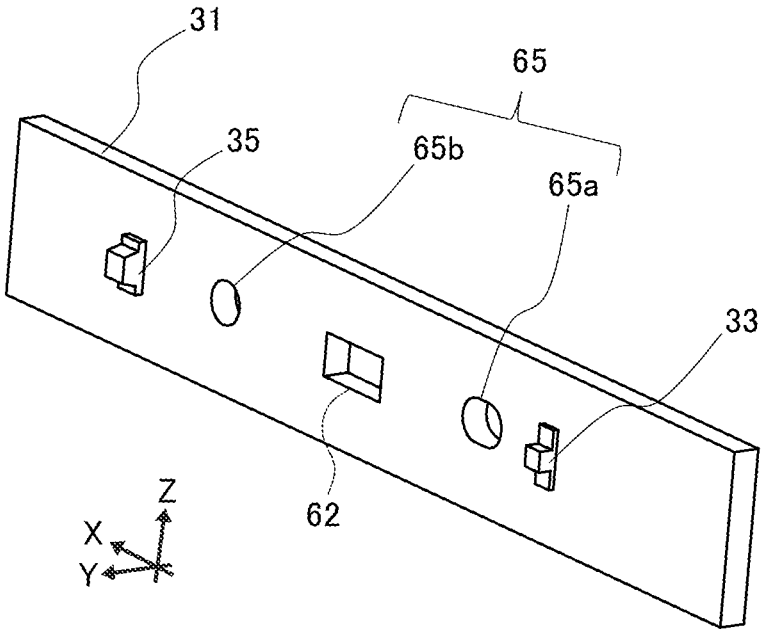
FIG. 4 is a sensor substrate according to the first embodiment.

FIG. 4 is a perspective view of the sensor substrate 31. Positioning holes 65*a* and 65*b* serving as a positioning portion 65 for fixing the position of the sensor substrate 31 with respect to the fixing stage 29, and a through hole 62 serving as a held portion held by the fixing stage 29 are defined in the sensor substrate 31. A light-emitting portion 33 serving as a light-emitting element or a first optical element portion that emits light, and a light-receiving portion 35 serving as a light-receiving element or a second optical element portion for optically detecting a sheet in cooperation with the light-emitting portion 33 are mounted on the sensor substrate 31.

As the light-emitting portion 33, a light-emitting diode: LED, which is an electroluminescent device, is preferably used for its low power consumption. As the light-emitting portion 33 of the present embodiment, for example, an infrared LED having a peak wavelength of 850 nm is used, and the output value thereof is about 40 mA to 25 mA. To be noted, an LED having a dominant wavelength of 850 nm may be used as the light-emitting portion 33, and an LED having wavelength parameters different from those of any LED described above such as a visible light LED may be used as the light-emitting portion 33. In the description below, it is assumed that the scope of "light" that the sheet detection mechanism 32 of an optical type uses for detection of the sheet includes arbitrary electromagnetic waves that can be blocked by a plain paper sheet that is widely used as a recording material in addition to visible light and infrared light, and "light amount" refers to radiation energy of such light.

As the light-receiving portion 35, a phototransistor can be preferably used. The phototransistor of the light-receiving portion 35 outputs a voltage of about 3.3 V in a state in which the light-receiving portion 35 is not receiving light. When the light-receiving portion 35 receives light emitted from the light-emitting portion 33, it becomes easier for a current to flow therein, and thus the output voltage serving as a detection signal output from the sensor unit 20 becomes smaller. In addition, an electric circuit is formed on the sensor substrate 31, and the light-emitting portion 33 and the light-receiving portion 35 are electrically connected to the controller 1C. To be noted, an effect substantially the same as that described below can be also obtained in the case where the positions of the light-emitting portion 33 and the light-receiving portion 35 illustrated in FIGS. 2A to 3C are reversed.

In addition, as illustrated in FIGS. 2A to 3C, the reflection plate 44 serving as a reflection member is fixed to the guide surface 45*a* of the second conveyance guide 45, and reflects the light emitted from the light-emitting portion 33 toward the light-receiving portion 35 by mirror reflection. The light-emitting portion 33 and the light-receiving portion 35 are arranged in the sheet width direction X at approximately same positions in the conveyance direction Z, the position of the reflection plate 44 in the conveyance direction Z overlaps with the light-emitting portion 33 and the light-receiving portion 35, and is positioned between the light-emitting portion 33 and the light-receiving portion 35 in the sheet width direction X. To be noted, FIG. 3B illustrates a light beam Lb passing through the shortest path among paths from the light-emitting portion 33 to the light-receiving portion 35 via the reflection plate 44 as a representative example of light beams from the light-emitting portion 33 to the light-receiving portion 35 via the reflection plate 44.

As the reflection member, a member having at least a higher reflectance to the light emitted from the light-emitting portion 33 than the guide surface 45*a* is used. In the present embodiment, the reflection plate 44 constituted by a glossy metal plate, specifically a stainless steel plate is used as the reflection member. Although the reflection member is not limited to this, and a resin sheet which is formed from polyethylene terephthalate: PET or the like and on which aluminum has been deposited, or a mirror formed by depositing aluminum or silver on the surface of glass may be used as the reflection member, a metal plate is preferable in consideration of the stability of output of the light-receiving portion 35. Particularly stainless steel is preferable, and among stainless steel, ferrite-based stainless steel containing chromium by 18% is preferable. This is because the surface thereof is not easily deformed even in the vicinity of the fixing unit 18 whose temperature changes relatively drastically, and thus light can be reflected stably. In addition, stainless steel is resistant against erosion even in a high-humidity environment, and in the case where stainless steel is used, a glossy surface can be obtained at low cost, and thus the amount of light reflected toward the light-receiving portion 35 can be stably increased. To be noted, the "direction toward the light-receiving portion 35" includes not only a direction in which the light directly travels toward the light-receiving portion 35 as indicated by an arrow in FIG. 3B, but also a direction in which light indirectly travels toward the light-receiving portion 35 via a light guidance portion that will be described later, another reflection member, or the like.

Figure 5A:
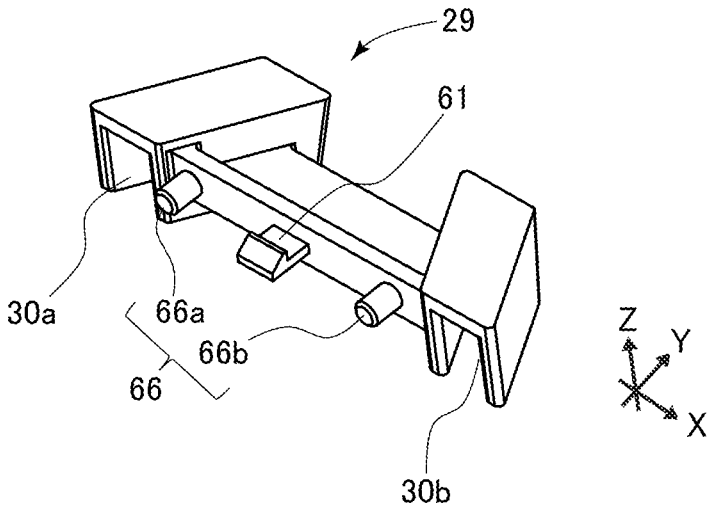
FIGS. 5A and 5B are each a perspective view of a fixing stage according to the first embodiment.
Figure 5B:
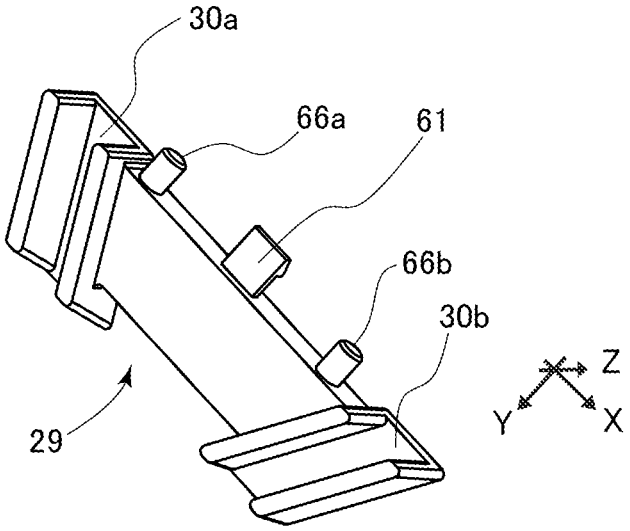

FIG. 5 is a perspective view of the fixing stage 29. As illustrated in FIGS. 5A and 5B, the fixing stage 29 includes a holding portion 61 that holds the sensor substrate 31, and protrusions 66*a* and 66*b* that serve as a positioning portion 66 and respectively engage with the positioning holes 65*a* and 65*b* of the sensor substrate 31 to position the sensor substrate 31. In the case of attaching the sensor substrate 31 to the fixing stage 29, the protrusions 66*a* and 66*b* are engaged with the positioning holes 65*a* and 65*b*, and thus the sensor substrate 31 is positioned in a direction along the main surface of the sensor substrate 31, which is the sheet width direction X and the conveyance direction Z in the present embodiment. In addition, a claw of the holding portion 61 engages with the back surface of the sensor substrate 31 through the through hole 62 of the sensor substrate 31, and thus the sensor substrate 31 is positioned in the thickness direction Y and fixed to the fixing stage 29. To be noted, the method for positioning and fixing the sensor substrate 31 and the fixing stage 29 is not limited to one described above, and for example, these two may be fastened to each other by using a screw.

To be noted, by disposing the protrusions 66*a* and 66*b* for positioning between the light-emitting portion 33 and the light-receiving portion 35 as illustrated in FIG. 3B, even in the case where there is a minute gap between the fixing stage 29 and the sensor substrate 31, the light from the light-emitting portion 33 leaking from the gap being directly received by the light-receiving portion 35 can be suppressed. That is, this contributes to improvement in the detection accuracy of the sheet detection mechanism 32. That is, it suffices as long as at least one of the protrusions 66*a* and 66*b* overlaps with the light-emitting portion 33 and the light-receiving portion 35 as viewed in a direction from the light-emitting portion 33 to the light-receiving portion 35. To be noted, a configuration in which a protrusion for positioning or a through hole which a screw penetrates is provided in the sensor substrate 31 and a positioning hole that engages with the protrusion or a female screw that engages with the screw is provided in the fixing stage 29 such that the protrusion or the screw is positioned between the light-emitting portion 33 and the light-receiving portion 35 may be employed.

Here, as illustrated in FIGS. 5A and 5B, the fixing stage 29 includes a first light guidance portion 30*a* that has an approximate tubular shape and guides the light emitted from the light-emitting portion 33 to the conveyance path, and a second light guidance portion 30*b* that has an approximate tubular shape and guides the light from the conveyance path to the light-receiving portion 35. The first light guidance portion 30*a* functions as a first light-passing portion that is provided to define an optical path from the light-emitting portion 33 to the conveyance path, and the second light guidance portion 30*b* functions as a second light-passing portion that is provided to define an optical path from the conveyance path to the light-receiving portion 35. The first light guidance portion 30*a* abuts the sensor substrate 31 while a first opening end of the tubular shape thereof surrounds the light-emitting portion 33, and opens toward a first opening portion 41*a* defined in the guide surface 28*a* of the first conveyance guide 28 at a second opening end thereof. The second light guidance portion 30*b* abuts the sensor substrate 31 while a first opening end of the tubular shape thereof surrounds the light-receiving portion 35, and opens toward a second opening portion 41*b* defined in the guide surface 28*a* of the first conveyance guide 28 at a second opening end thereof. Therefore, the space inside the first light guidance portion 30*a* and the second light guidance portion 30*b* communicates with the conveyance path, which is a space between the first conveyance guide 28 and the second conveyance guide 45, through the opening portions of the first conveyance guide 28.

To be noted, the first light guidance portion 30*a* and the second light guidance portion 30*b* of the present embodiment are each formed to have a tubular shape part of whose side surface is opened in section view, that is, an angular C shape. Further, the opening side of each of the first light guidance portion 30*a* and the second light guidance portion 30*b* are blocked by the flat surface portion 28*b* of the first conveyance guide 28 as illustrated in FIGS. 2A to 3C, and thus the tubular shape surrounding the optical path is formed. The flat surface portion 28*b* of the first conveyance guide 28 is a surface extending away from the conveyance path from an upstream end of the guide surface 28*a* in the conveyance direction Z. The flat surface portion 28*b* of the first conveyance guide 28 also functions as an attachment surface to which the sensor unit 20 can be attached from above. To be noted, instead of employing the configuration in which the tubular shapes surrounding the optical path are formed by blocking the opening portions of the first light guidance portion 30*a* and the second light guidance portion 30*b* by part of the first conveyance guide 28, the first light guidance portion 30*a* and/or the second light guidance portion 30*b* may be formed in a complete tubular shape such as an angular tube shape or a cylindrical shape. That is, the first light-passing portion constitutes at least part of an inner surface of a tubular shape having a first opening end and a second opening end, the first opening end opposing a substrate on which the light-emitting element is provided, the second opening end communicating with the conveyance path. The second light-passing portion constitutes at least part of an inner surface of a tubular shape having a third opening end and a fourth opening end, the third opening end opposing a substrate on which the light-receiving element is provided, the fourth opening end communicating with the conveyance path.

The directions in which the first light guidance portion 30*a* and the second light guidance portion 30*b* extend, that is, the directions of the central axes of the tubular shapes are preferably set to directions along a V-shaped shortest path from the light-emitting portion 33 to the light-receiving portion 35 via the reflection plate 44 as indicated by the light beam Lb in FIG. 3B. As a result of this, the light emitted from the light-emitting portion 33 can be efficiently guided toward the reflection plate 44, and the light traveling from the reflection plate 44 to the light-receiving portion 35 can be efficiently collected.

Detection Operation

Next, a sheet detection operation by the sheet detection mechanism 32 will be described. A section view of FIG. 3B illustrates the sheet detection mechanism 32 in a state in which no sheet is present in the conveyance path. In the state in which no sheet is present, the light emitted from the light-emitting portion 33 is radiated into the conveyance path through the first light guidance portion 30*a*, and is reflected by the reflection plate 44. The light reflected by the reflection plate 44 is incident on the light-receiving portion 35 through the second light guidance portion 30*b*. Then, it becomes easier for a current to flow in the phototransistor of the light-receiving portion 35, and the output voltage of the light-receiving portion 35 is lowered.

The controller 1C of the present embodiment has set in advance a threshold value for the output voltage of the light-receiving portion 35, and determines that there is no sheet in the conveyance path in the case where the output voltage is lower than the threshold value. That is, in the state of FIGS. 3A to 3C, the output voltage is lower than the threshold value, and therefore the controller 1C determines that there is no sheet in the conveyance path, that is, detects the absence of the sheet. To be noted, whether a case where the output voltage equals to the threshold value corresponds to the absence of the sheet or corresponds to the presence of the sheet can be arbitrarily set in advance.

Figure 6A:
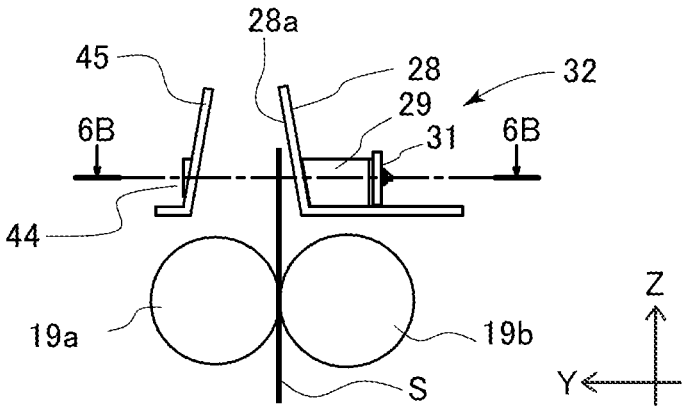
FIGS. 6A and 6B are each a diagram for describing an operation of the sheet detection mechanism according to the first embodiment.
Figure 6B:
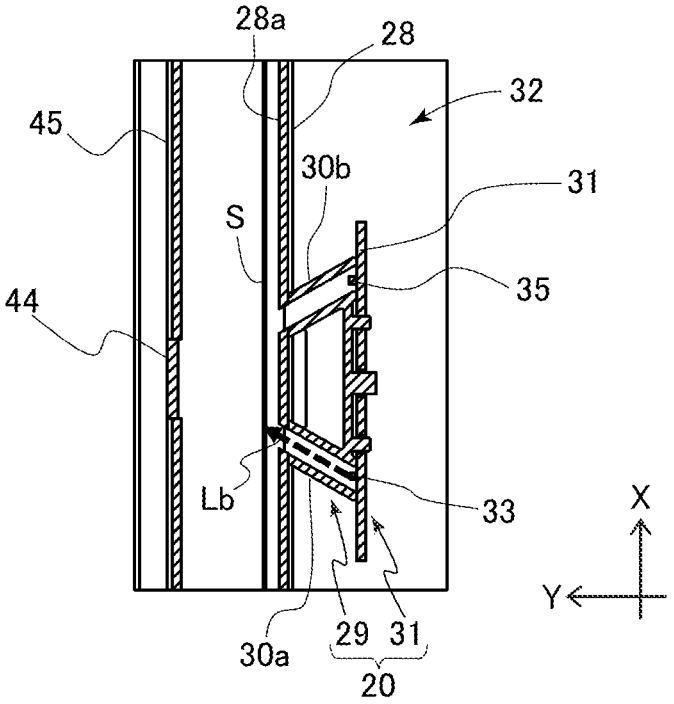

FIGS. 6A and 6B illustrate the sheet detection mechanism 32 in a state in which a sheet S is present in the conveyance path. FIG. 6A is a side view of the sheet detection mechanism 32 as viewed in the sheet width direction X. FIG. 6B is a section view of the sheet detection mechanism 32 taken along a line 6B-6B of FIG. 6A indicating a virtual plane along one of optical paths of the sheet detection mechanism 32. In the present embodiment, FIG. 6B is a section view taken along a virtual plane perpendicular to the conveyance direction Z.

As illustrated in FIG. 6B, in the state in which the sheet S is present, the light from the light-emitting portion 33 is blocked by the sheet S, and does not reach the light-receiving portion 35 as indicated by the light beam Lb. In this case, no current flows in the phototransistor of the light-receiving portion 35, and the output voltage is not lowered. Since the output voltage of the light-receiving portion 35 is higher than the threshold value, the controller 1C determines that a sheet S is present in the conveyance path, that is, detects the presence of the sheet S.

In other words, the sheet detection mechanism 32 of the present embodiment has a reflection-type configuration in which a light-emitting element, a first light-passing portion, a light-receiving element, and a second light-passing portion are disposed on the first side of the conveyance path in the thickness direction Y, and a reflection member is disposed on the second side opposite to the first side of the conveyance path in the thickness direction Y. Further, in the case where no sheet is present in the conveyance path, the light emitted from the light-emitting element reaches the light-receiving element through the optical path from the first light-passing portion to the second light-passing portion via the reflection member, and in the case where a sheet is present in the conveyance path, the optical path from the first light-passing portion to the second light-passing portion via the reflection member is blocked by the sheet. That is, the sheet detection mechanism 32 is configured such that, in the case where a sheet is present in the conveyance path, the amount of light incident on the light-receiving element will be smaller than in the case where no sheet is present in the conveyance path.

Factor for Degradation of Detection Accuracy

However, depending on the actual condition at the time when the sheet detection mechanism 32 detects the sheet, the output voltage of the light-receiving portion 35 in the state in which no sheet is present might be higher than 0 V and the output voltage in the state in which a sheet is present might be lower than a theoretical value, which is 3.3 V in the present embodiment. That is, there might be a case where the amount of change of the output voltage corresponding to the presence or absence of the sheet is small and a margin large enough to avoid erroneous detection cannot be secured between the output voltage and the threshold value of the output voltage. A "conventional example" illustrated in FIG. 8 indicates a case where the output value in the state in which no sheet is present and the output value in the state in which a sheet is present have become closer to a threshold value P due to a plurality of factors. The reasons why the output voltage of the light-receiving portion 35 becomes closer to the threshold value P will be described below.

(1) Decrease in Light Amount of LED

Figure 8:
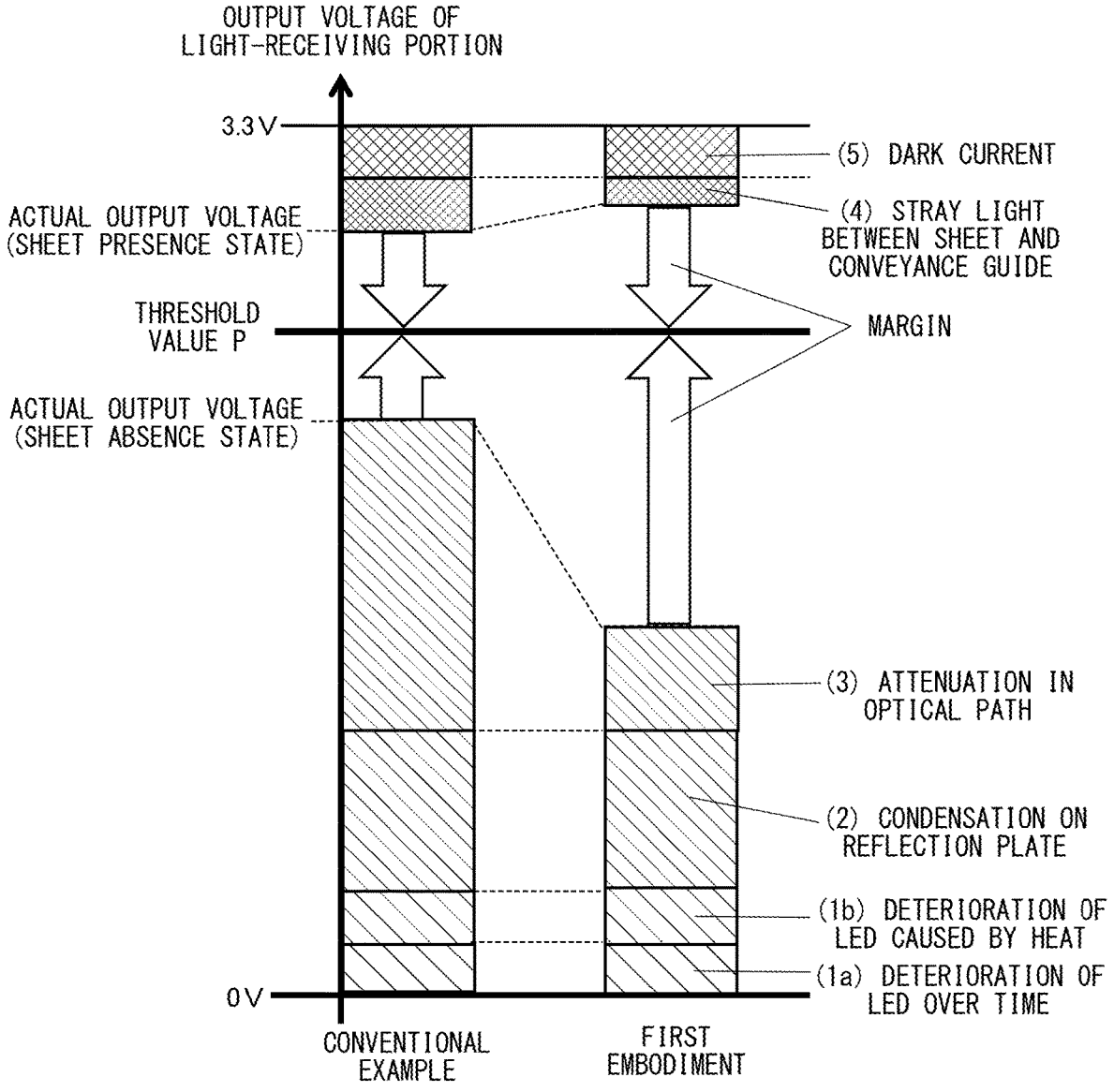
FIG. 8 is a graph illustrating a relationship between an output voltage of a light-receiving portion and a threshold value for the first embodiment and a conventional example.

It is generally known that the light amount of the LED used as the light-emitting portion 33 decreases as the accumulated light emission time increases as indicated by (1a) in FIG. 8. Further, it is also known that the decrease in the light amount of the LED corresponding to the accumulated light emission time is larger under the influence of heat as indicated by (1b) in FIG. 8. As a result of this, the amount of light that reaches the light-receiving portion 35 decreases, and thus the output voltage becomes high even in the state in which no sheet is present.

(2) Condensation on Reflection Plate

When the image forming operation is repetitively performed and a plurality of sheets are successively conveyed, water vapor is generated from the sheets due to heat generated by the fixing unit 18, and sometimes the water vapor condenses on a member in the optical path, particularly the reflection plate 44. When condensation occurs in the reflection plate 44, the ratio of the light amount of the light reflected on the reflection plate 44 by mirror reflection to the light amount of the light incident on the reflection plate 44, that is, the reflectance, decreases. When the reflectance of the reflection plate 44 decreases, the amount of light that reaches the light-receiving portion 35 decreases, and the output voltage becomes high even in the state in which no sheet is present in the conveyance path as indicated by (2) in FIG. 8.

(3) Attenuation of Light in Optical Path

In an optical path in which the light emitted from the light-emitting portion 33 is radiated into the conveyance path through the first light guidance portion 30*a*, then is reflected by the reflection plate 44, and reaches the light-receiving portion 35 through the second light guidance portion 30*b*, the light attenuates due to absorption and scattering by the members constituting the optical path. As a result, the amount of light that reaches the light-receiving portion 35 decreases, and the output voltage becomes high even in the state in which no sheet is present as indicated by (3) in FIG. 8.

To be noted, to suppress the influence of heat indicated by (1b) described above, providing a fan or air channel to blow cooling air to the light-emitting portion 33, the light-receiving portion 35, and the reflection plate 44 can be also considered. However, when such an element for blowing cooling air is provided, the production cost and the size of the apparatus increase. In addition, in this case, sometimes toner scatters in the image forming apparatus 1 and attaches to the reflection plate 44, the first light guidance portion 30*a*, or the second light guidance portion 30*b*, and the attenuation of the light in the optical path increases.

(4) Stray Light between Sheet and Conveyance Guide

Figure 7:
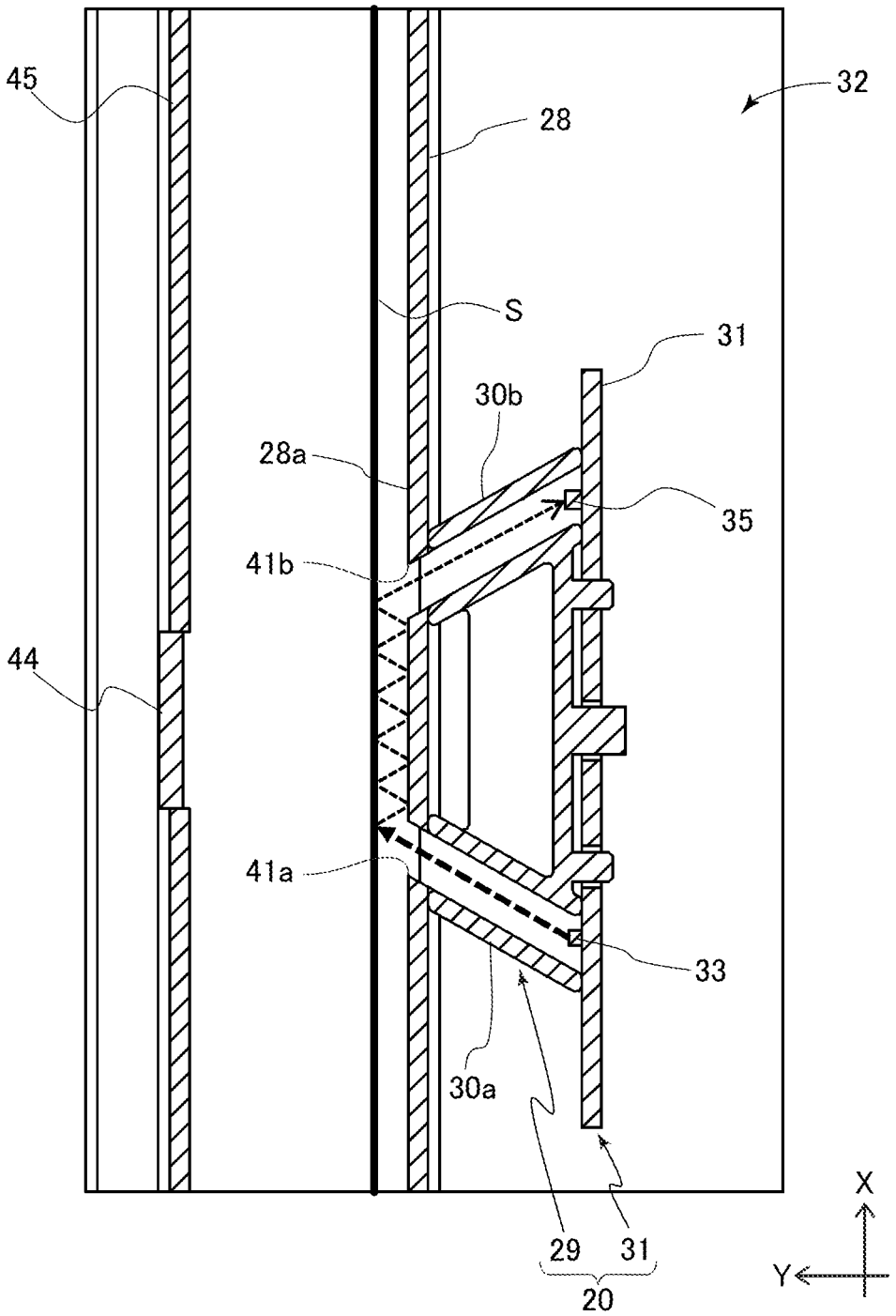
FIG. 7 is a diagram for describing an influence of diffuse reflection light in the first embodiment.

Meanwhile, even if a sheet S is present in the conveyance path, it is not necessarily the case that no light reaches the light-receiving portion 35. Actually, part of the light reaches the light-receiving portion 35 as stray light. Part of the light reaches the light-receiving portion 35 while being reflected between the sheet S and the first conveyance guide 28 as illustrated in FIG. 7, and thus the output voltage of the light-receiving portion 35 is lowered as indicated by (4) in FIG. 8. Further, sheets used as recording materials in the image forming apparatus have been diversified in recent years, and in the case where the sheet S is of a type that reflects more light, more stray light reaches the light-receiving portion 35, and the output voltage is lowered further.

(5) Dark Current

As the nature of the phototransistor used as the light-receiving portion 35, a leak current or a dark current flows therein even in a state in which no light is incident thereon. The dark current acts so as to lower the output voltage of the light-receiving portion 35 as indicated by (5) of FIG. 8.

For the reasons (1a) to (5) described above as examples, in a conventional example, sometimes the output voltage of the light-receiving portion 35 in the sheet absence state increases and the output voltage in the sheet presence state decreases, and thus the amount of change of the output voltage corresponding to the presence or absence of the sheet becomes small as illustrated on the left side in FIG. 8. To suppress erroneous detection, it is desirable that a threshold value P that allows a sufficient margin from the output voltage in an actual use condition to be secured is set, but it becomes difficult to secure the margin in the case where the amount of change of the output voltage corresponding to the presence or absence of the sheet is small. Therefore, there is a possibility that erroneous detection becomes more likely to occur when relatively disadvantageous conditions as exemplified by (1a) to (5) are piled up.

When erroneous detection of the sheet detection mechanism 32 occurs, there is a possibility that abnormality occurs in the control performed by the controller 1C on the basis of the detection signal of the sheet detection mechanism 32. Therefore, in the conventional example, sometimes this is addressed by setting the lifetime of the sheet detection mechanism 32 or the image forming apparatus 1 in consideration of the influence that becomes greater in accordance with the accumulation of the light emission time such as (1a) and (1b) described above. Regarding this, as a method for lowering the possibility of erroneous detection, maintaining the light amount of the light-emitting portion 33 even after increase in the accumulated light emission time, by setting the amount of light emission of the light-emitting portion 33 to a sufficiently large value can be considered. However, when the amount of light emission of the light-emitting portion 33 is set to a large value, there is a possibility that the deterioration of the light-emitting portion 33 becomes faster and the lifetime of the sensor unit 20 becomes shorter.

Details of Sheet Detection Mechanism of Present Embodiment

Therefore, in the present embodiment, the following configuration is employed such that more light reaches the light-receiving portion 35 in the sheet absence state, and less light reaches the light-receiving portion 35 in the sheet presence state. First, to suppress the attenuation of the light in the optical path from the light-emitting portion 33 to the conveyance path and the optical path from the conveyance path to the light-receiving portion 35, the fixing stage 29 is formed from white resin. Further, the surface of the first light guidance portion 30*a* and the second light guidance portion 30*b* constituting the optical path, that is, the inner surface of the tubular shapes serving as light guidance surface is mirror-finished. The mirror finishing is a surface finishing method that reduces the unevenness of the surface of a member by a method such as buff polishing such that the surface of the member has gloss, and for example, the mirror-finished surface has an arithmetic average roughness Ra of 0.2 μm or less.

In contrast, to reduce the stray light that reaches the light-receiving portion 35 through a gap between the sheet and the conveyance guide, the first conveyance guide 28 is formed from black resin. The black resin may be formed by, for example, kneading a component having high light absorbance such as carbon black in a resin material serving as a base material. In addition, the guide surface 28*a* of the first conveyance guide 28 is matte-finished to further reduce the stray light. Matte finishing is a surface finishing method that increases the unevenness, that is, the surface area of the surface of a member by a method such as application of a paint containing particles or sand blasting, and the matte-finished surface has, for example, an arithmetic average roughness Ra of 1.6 μm or more. To be noted, for example, the arithmetic average roughness Ra of the guide surface 28*a* is preferably set to 6.3 μm or less so as not to hinder the conveyance of the sheet.

As a result of the configuration described above, the reflectance of each of the first light guidance portion 30*a* and the second light guidance portion 30*b* to the light emitted from the light-emitting portion 33 is set to be higher than the reflectance of the first conveyance guide 28 to the light emitted from the light-emitting portion 33. In other words, the reflectance of each of the first light-passing portion and the second light-passing portion to the light emitted from the light-emitting element is configured to be higher than the reflectance of the guide member to the light emitted from the light-emitting element.

The reflectance of each of the light guidance surface of the first light guidance portion 30*a* and the second light guidance portion 30*b* serving as a first reflectance is preferably 3% or more, and more preferably 4% or more. In contrast, the reflectance of the guide surface 28*a* of the first conveyance guide 28 to the light emitted from the light-emitting portion 33 is preferably 1.5% or less, and more preferably 1% or less. In the present embodiment, the reflectance of the mirror-finished white resin to the light emitted from the light-emitting portion 33 is about 4%, and the reflectance of the matte-finished black resin to the light emitted from the light-emitting portion 33 is about 1%.

To be noted, the reflectance of the first light guidance portion 30*a* and the reflectance of the second light guidance portion 30*b* may be different from each other as long as the conditions described above are satisfied.

In addition, although the entirety of the guide surface 28*a* of the first conveyance guide 28 is formed from matte-finished black resin in the present embodiment, a configuration in which the reflectance is reduced only in a region that largely contributes to the stray light finally reaching the light-receiving portion 35 may be employed. The region that largely contributes to stray light is, for example, a peripheral portion of the first opening portion 41*a* and the second opening portion 41*b* of the guide surface 28*a* illustrated in FIG. 2A. Therefore, the reflectance of each of the first light guidance portion 30*a* and the second light guidance portion 30*b* may be of any value as long as the reflectance is at least higher than the reflectance of the peripheral portion of the first opening portion 41*a* and the second opening portion 41*b* of the guide surface 28*a* in the first conveyance guide 28 serving as a guide member.

Figure 17A:
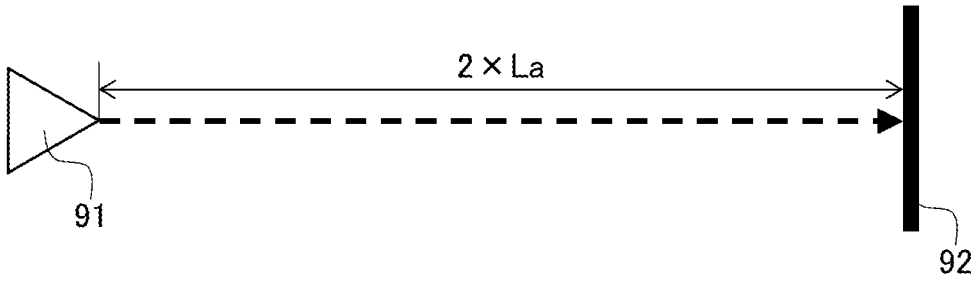
FIGS. 17A and 17B are each a diagram for describing a method for measuring reflectance.
Figure 17B:
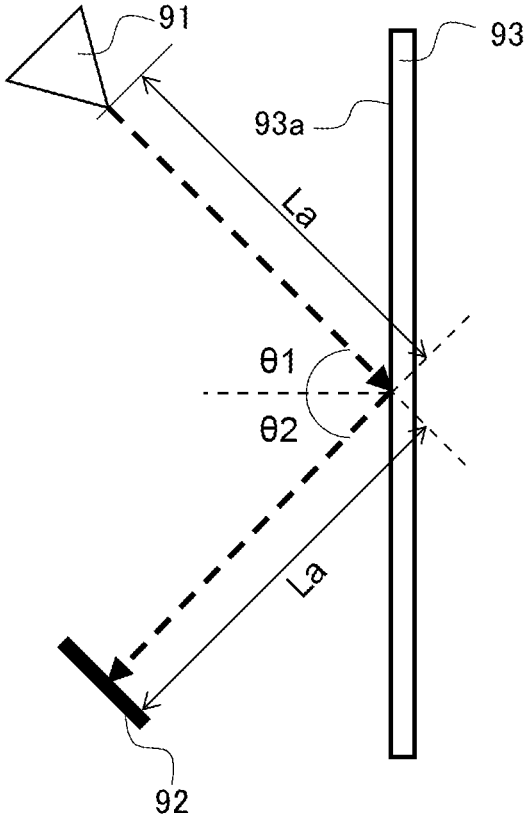

FIGS. 17A and 17B illustrate a method for measuring the reflectance. FIG. 17A is a schematic diagram illustrating how light emitted from a light-emitting portion 91 is measured by a light amount meter 92 disposed on an optical axis. FIG. 17B is a schematic diagram illustrating how the light emitted from the light-emitting portion 91 is reflected on a measurement surface 93*a* of a measurement target material 93 and measured by the light amount meter 92. As the light-emitting portion 91, the same light-emitting element as the light-emitting portion 33 of the sheet detection mechanism 32 is used. In the present embodiment, the light-emitting element is an infrared LED.

In FIG. 17A, the optical path length from the light-emitting portion 91 to the light amount meter 92 is 2×La. In this case, in FIG. 17B, the optical path length from the light-emitting portion 91 to the measurement surface 93*a* of the measurement target material 93 is La, and the distance from the measurement surface 93*a* of the measurement target material 93 to the light amount meter 92 is La. In addition, an incident angle θ1 of the light emitted from the light-emitting portion 91 and a reflection angle θ2 on the measurement surface 93*a* of the measurement target material 93 are each set to 45 deg. The output value of the light amount meter 92 in FIG. 17A is T, and the output value of the light amount meter 92 in FIG. 17B is H. The reflectance of the measurement surface 93*a* is expressed by HIT.

In the case where no sheet is present in the conveyance path as illustrated in FIGS. 3A to 3C, the light emitted from the light-emitting portion 33 is guided to the conveyance path while being reflected by the first light guidance portion 30*a* having a relatively high reflectance. In addition, the light reflected by the reflection plate 44 and having entered the second light guidance portion 30*b* is guided to the conveyance path while being reflected by the second light guidance portion 30*b* having a relatively high reflectance. Therefore, by setting the reflectance of the inner surface of the first light guidance portion 30*a* and the second light guidance portion 30*b* serving as light guidance surface to be high, the attenuation of light in the first light guidance portion 30*a* and the second light guidance portion 30*b* indicated by (3) in FIG. 8 can be suppressed as compared with the conventional example. In other words, by setting the reflectance of the inner surface of the first light guidance portion 30*a* and the second light guidance portion 30*b* to be high, the ratio of light that reaches the light-receiving portion 35 in the end to all light emitted from the light-emitting portion 33, that is, to total radiant flux, can be increased.

In contrast, in the case where a sheet S is present in the conveyance path as illustrated in FIGS. 6A and 6B, the light reflected by the sheet S is absorbed by the first conveyance guide 28 having a relatively low reflectance. Therefore, by setting the reflectance of the guide surface 28*a* of the first conveyance guide 28 to be low, the amount of stray light reaching the light-receiving portion 35 through reflection between the sheet S and the first conveyance guide 28 indicated by (4) in FIG. 8 can be suppressed as compared with the conventional example. Particularly, since the amount of stray light reaching the light-receiving portion 35 can be suppressed even under conditions in which reflection of light by the sheet S is relatively likely to occur, such as a case where the sheet S has a glossy surface, high detection accuracy can be obtained for a wide variety of types of sheets.

As a result, the difference in the output voltage of the light-receiving portion 35 between the sheet absence state and the sheet presence state becomes larger as illustrated on the right side of FIG. 8, and it becomes easier to secure a sufficient margin between the output voltage and the threshold value P set in advance. Further, the controller 1C determines the presence or absence of the sheet on the basis of the output voltage of the light-receiving portion 35, thus the presence or absence of the sheet in the conveyance path can be determined more accurately, and occurrence of erroneous detection can be suppressed.

That is, according to the configuration of the present embodiment, the possibility of erroneous detection can be lowered and the detection accuracy can be maintained, in other words, high detection accuracy can be stably realized, even under relatively disadvantageous conditions. As a result, for example, even in the case where the amount of light emission from the LED serving as the light-emitting portion 33 has decreased due to the increase in the accumulated light emission time as indicated by (1a) and (1b) in FIG. 8, the attenuation of light in the optical path indicated by (3) can be suppressed, and big decrease in the amount of light received by the light-receiving portion 35 can be suppressed. Therefore, the lifetime of the sheet detection mechanism 32 and the image forming apparatus 1 can be set to be longer than in the conventional example while maintaining the detection accuracy of the sheet.

As described above, according to the present embodiment, the lifetime of the sheet detection mechanism 32 and the image forming apparatus 1 can be elongated while maintaining the detection accuracy. The sheet detection mechanism 32 of the present embodiment can be preferably used for detecting a sheet in the vicinity of the fixing unit 18 of a thermal fixation system.

Modification Example

Although mirror-finished white resin is used for increasing the reflectance of each of the first light guidance portion 30*a* and the second light guidance portion 30*b* in the first embodiment described above, the configuration is not limited to this as long as the reflectance of each of the first light guidance portion 30*a* and the second light guidance portion 30*b* is higher than the reflectance of the first conveyance guide 28. For example, a metal tape such as an aluminum tape may be stuck on the light guidance surface of the first light guidance portion 30*a* and the second light guidance portion 30*b*, a paint containing metal may be applied on the light guidance surface, or a metal film or a metal layer may be formed on the light guidance surface by vapor deposition of metal or the like. In addition, the first light guidance portion 30*a* and the second light guidance portion 30*b* may be formed from a metal material such as stainless steel.

Meanwhile, although matte-finished black resin is used for suppressing the reflectance of the first conveyance guide 28 in the first embodiment described above, the configuration is not limited to this as long as the reflectance of the first conveyance guide 28 is lower than the reflectance of each of the first light guidance portion 30*a* and the second light guidance portion 30*b*. For example, a carbon-based material or paint having high light absorbance may be stuck or applied on at least a region al of the guide surface 28*a* of the first conveyance guide 28. For example, the paint having high light absorbance is a paint that has absorbance of 99% or more for light in a wide wavelength band. Specific examples of the paint include Vantablack™ manufactured by Surrey Nano System and having an absorbance of 99.965%, and Musou Black™ manufactured by Koyo Orient Japan Co., Ltd. and having an absorbance of 99.3%.

In addition, although a V-shaped optical path from the light-emitting portion 33 to the light-receiving portion 35 via the reflection plate 44 is formed along an X-Y plane perpendicular to the sheet conveyance direction Z in the first embodiment described above, the design of the optical path can be appropriately modified. For example, a V-shaped optical path may be formed along a Y-Z plane perpendicular to the sheet width direction X as a configuration in which the light-emitting portion 33 and the light-receiving portion 35 are arranged in the conveyance direction Z. In addition, an optical path in which the light emitted into the conveyance path travels toward the light-receiving portion 35 through a plurality of times of mirror reflection, for example, a C-shaped optical path may be formed by disposing a plurality of reflection members on the first conveyance guide 28 and the second conveyance guide 45. In addition, an L-shaped optical path in which light reflected by a reflection member reaches the light-receiving portion 35 through a path on the back side of the guide surface 28*a* or 45*a* may be formed by disposing the light-emitting portion 33 on a first side of the conveyance path in the thickness direction Y and disposing the light-receiving portion 35 and the reflection member on a second side opposite to the first side of the conveyance path in the thickness direction Y.

To be noted, the first light-passing portion and the second light-passing portion are not limited to members forming tubular shapes like the first light guidance portion 30*a* and the second light guidance portion 30*b* of the present embodiment. For example, when a directional LED is used as the light-emitting portion 33 and the light-emitting portion 33 is mounted such that the center axis of the emitted light is directed toward the light-receiving portion 35 via reflection on the reflection plate 44, the first light-passing portion and the second light-passing portion are formed to have shapes opening so as not to intersect with the center axis. At this time, a surface for guiding light that is displaced from the center axis and cannot reach the light-receiving portion 35 without the first light-passing portion and the second light-passing portion to the light-receiving portion 35 may be provided on at least one side with respect to the center axis and used as the first light-passing portion and the second light-passing portion.

Second Embodiment

Next, a second embodiment will be described with reference to drawings. In the present embodiment, a configuration in which the light-emitting portion and the light-receiving portion are disposed on opposite sides of the conveyance path is used. In the description below, it is assumed that elements denoted by the same reference signs as in the first embodiment have substantially the same configuration and effects as in the first embodiment, and parts different from the first embodiment will be described.

Basic Configuration of Sheet Detection Mechanism

Figure 9A:
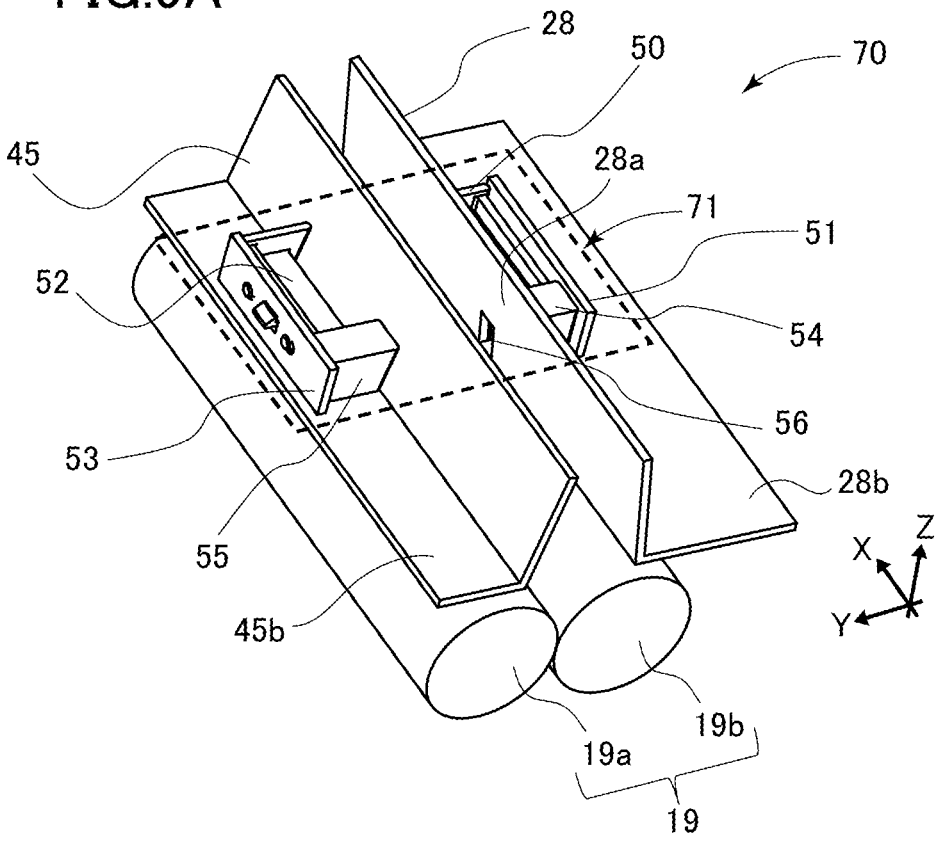
FIGS. 9A and 9B are each a perspective view of a sheet detection mechanism according to a second embodiment.
Figure 9B:
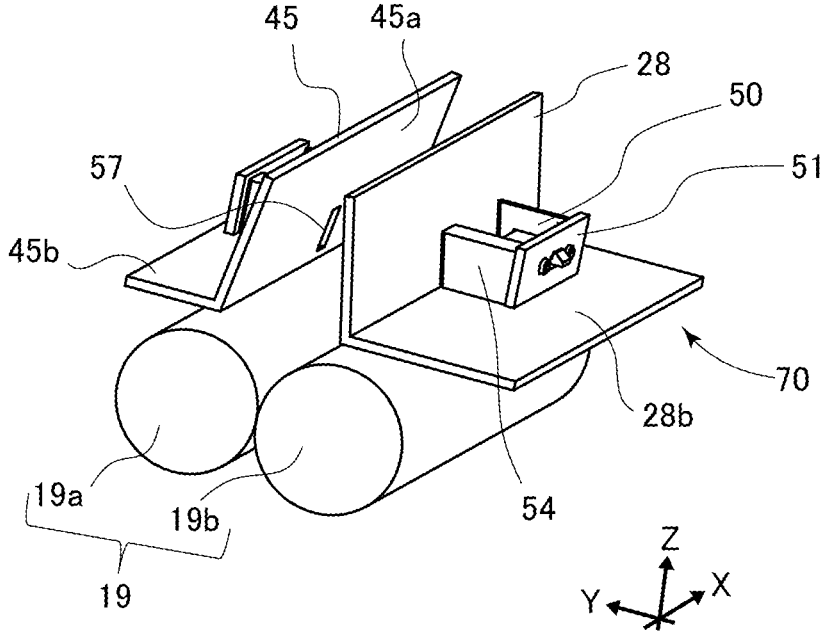
Figure 10A:
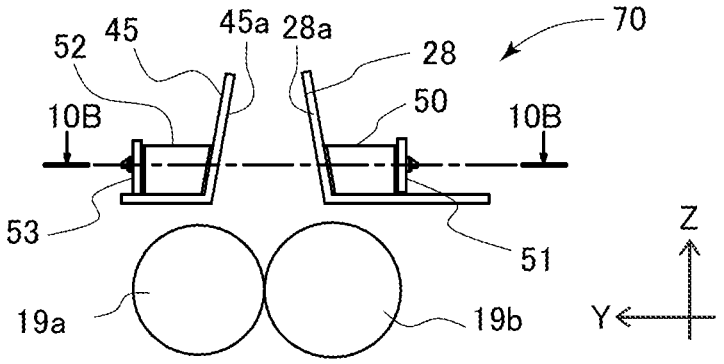
FIG. 10A is a side view of the sheet detection mechanism according to the second embodiment.
Figure 10B:
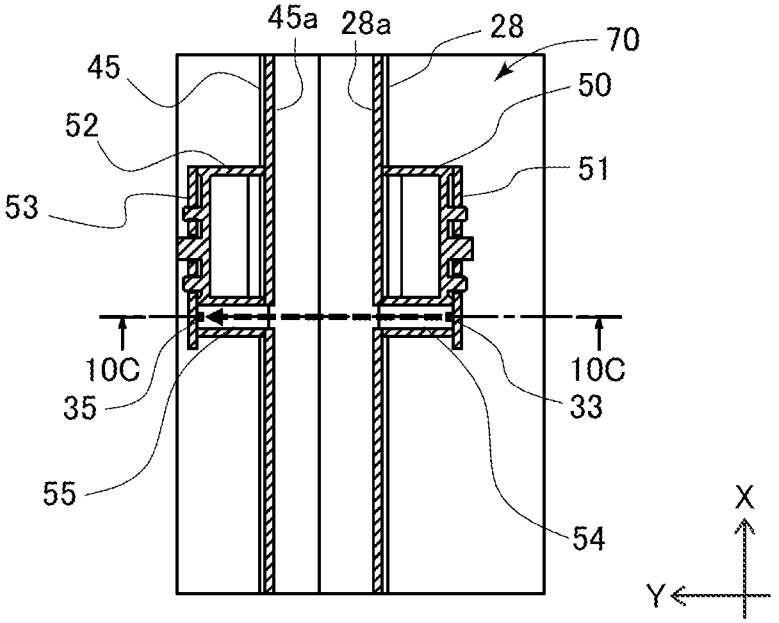
FIGS. 10B and 10C are each a section view of the sheet detection mechanism according to the second embodiment.
Figure 10C:
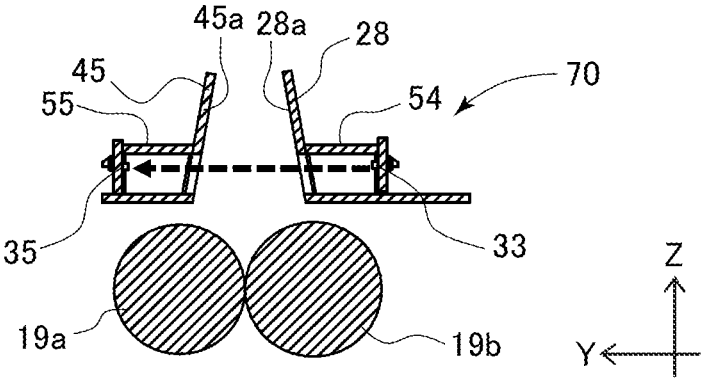

A basic configuration of a sheet detection mechanism 70 according to the present embodiment will be described. FIGS. 9A and 9B are each a perspective view of the sheet detection mechanism 70 according to the present embodiment. FIG. 10A is a side view of the sheet detection mechanism 70 as viewed in the sheet width direction X. FIG. 10B is a section view of the sheet detection mechanism 70 taken along a virtual plane along one of optical paths of the sheet detection mechanism 70 indicated by a line 10B-10B in FIG. 10A. In the present embodiment, the virtual plane is perpendicular to the conveyance direction Z. FIG. 10C is a section view of the sheet detection mechanism 70 taken along a virtual plane perpendicular to the sheet width direction X indicated by a line 10C-10C in FIG. 10B as viewed in the sheet width direction X.

As illustrated in FIGS. 9A to 10B, the sheet detection mechanism 70 includes a sensor unit 71 attached to a guide unit including the first conveyance guide 28 and the second conveyance guide 45 and defining a conveyance path downstream of the fixing roller pair 19 in the conveyance direction Z.

The sensor unit 71 includes a first fixing stage 50 attached to the first conveyance guide 28, a first sensor substrate 51 on which the light-emitting portion 33 is provided, a second fixing stage 52 attached to the second conveyance guide 45, and a second sensor substrate 53 on which the light-receiving portion 35 is provided. A first light guidance portion 54 defining an optical path from the light-emitting portion 33 to the conveyance path is formed on the first fixing stage 50 so as to extend from the first sensor substrate 51 to the guide surface 28*a* of the first conveyance guide 28. A second light guidance portion 55 defining an optical path from the conveyance path to the light-receiving portion 35 is formed on the second fixing stage 52 so as to extend from the guide surface 45*a* of the second conveyance guide 45 to the second sensor substrate 53.

The first light guidance portion 54 and the second light guidance portion 55 are each formed in an approximate tubular shape surrounding the optical path. To be noted, the first light guidance portion 54 and the second light guidance portion 55 of the present embodiment are each formed to have a tubular shape part of whose side surface is opened in section view, that is, an angular C shape. Further, the opening sides of the first light guidance portion 54 and the second light guidance portion 55 are respectively blocked by the flat surface portion 28*b* of the first conveyance guide 28 and the flat surface portion 45*b* of the second conveyance guide 45, and thus the tubular shape surrounding the optical path is formed. To be noted, the first light guidance portion 54 and the second light guidance portion 55 may be formed in a complete tubular shape such as an angular tube shape or a cylindrical shape.

The first light guidance portion 54 abuts the first sensor substrate 51 while a first end portion of the tubular shape thereof surrounds the light-emitting portion 33, and opens toward a first opening portion 56 defined in the guide surface 28*a* of the first conveyance guide 28 at a second opening end thereof as illustrated in FIGS. 9A and 10B. The second light guidance portion 55 abuts the second sensor substrate 53 while a first end portion of the tubular shape thereof surrounds the light-receiving portion 35, and opens toward a second opening portion 57 defined in the guide surface 45*a* of the second conveyance guide 45 at a second end portion thereof as illustrated in FIGS. 9B and 10B.

To be noted, as the method for positioning and fixing the first sensor substrate 51 to the first fixing stage 50 and the method for positioning and fixing the second sensor substrate 53 to the second fixing stage 52, the method of the first embodiment can be used. That is, a holding portion and a protrusion for positioning may be provided on each of the first fixing stage 50 and the second fixing stage 52, and a through hole serving as a held portion and a positioning hole that engages with the protrusion may be provided in each of the first sensor substrate 51 and the second sensor substrate 53.

Detection Operation

Next, a sheet detection operation by the sheet detection mechanism 70 will be described. FIG. 10B illustrates the sheet detection mechanism 70 in a state in which no sheet is present in the conveyance path. In this state, the light from the light-emitting portion 33 is radiated into the conveyance path through the inside of the first light guidance portion 54, then enters the second opening portion 57, and reaches the light-receiving portion 35 through the inside of the second light guidance portion 55. That is, the light travels along a linear optical path from the light-emitting portion 33 to the light-receiving portion 35. Therefore, in the state in which no sheet is present, a current is more likely to flow in the phototransistor of the light-receiving portion 35, and the output voltage is lowered. The controller 1C sets the threshold value P for the output voltage of the light-receiving portion 35 in advance, and determines a state in which the output voltage of the light-receiving portion 35 is lower than the threshold value P as the state in which no sheet is present.

Figure 11A:
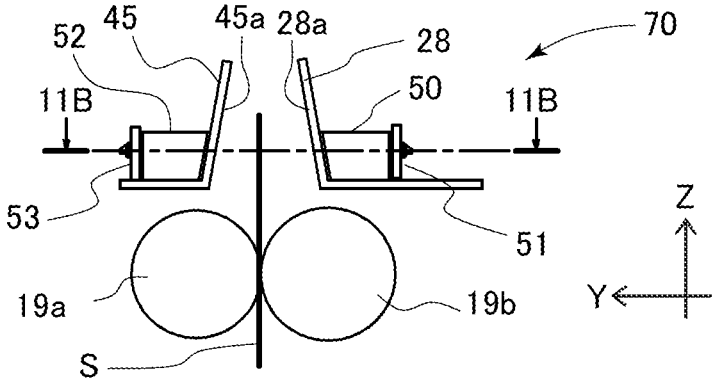
FIGS. 11A to 11C are each a diagram for describing an operation of the sheet detection mechanism according to the second embodiment.
Figure 11B:
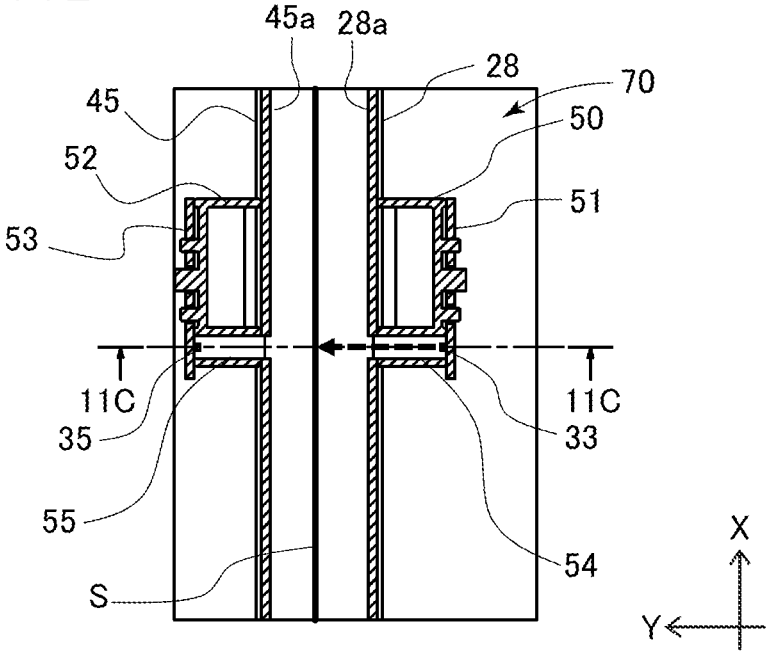
Figure 11C:
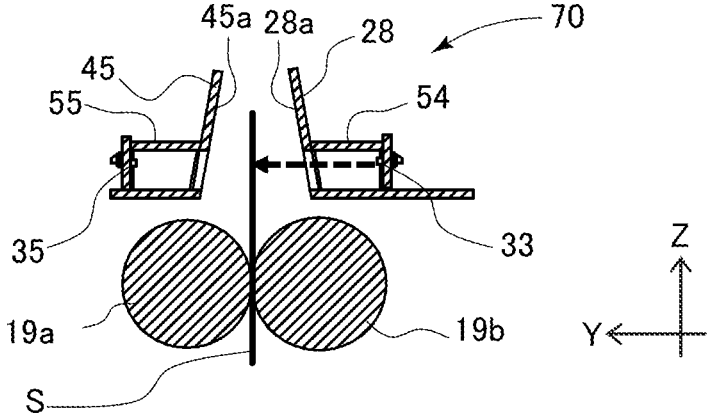

FIGS. 11A to 11C illustrate the sheet detection mechanism 70 in a state in which a sheet S is present in the conveyance path. FIG. 11A is a side view of the sheet detection mechanism 70 as viewed in the sheet width direction X. FIG. 11B is a section view of the sheet detection mechanism 70 taken along a line 11B-11B in FIG. 11A indicating a virtual plane along one of optical paths of the sheet detection mechanism 70. In the present embodiment, FIG. 11B is a section view taken along a virtual plane perpendicular to the conveyance direction Z. FIG. 11C is a section view of the sheet detection mechanism 70 taken along a virtual plane perpendicular to the sheet width direction X indicated by a line 11C-11C in FIG. 11B as viewed in the sheet width direction X.

As illustrated in FIG. 11B, in the state in which the sheet S is present, the light from the light-emitting portion 33 is blocked by the sheet S, and does not reach the light-receiving portion 35. In this case, no current flows in the phototransistor of the light-receiving portion 35, and the output voltage is not lowered. The controller 1C determines a state in which the output voltage of the light-receiving portion 35 is not lowered and is higher than the threshold value P as a state in which no sheet S is present.

In other words, the sheet detection mechanism 70 of the present embodiment has a transmission-type configuration in which a light-emitting element and a first light-passing portion are disposed on a first side of the conveyance path in the thickness direction Y, and a light-receiving element and a second light-passing portion are disposed on a second side opposite to the first side of the conveyance path in the thickness direction Y. Further, in the case where no sheet is present in the conveyance path, the light emitted from the light-emitting element reaches the light-receiving element through the optical path from the first light-passing portion to the second light-passing portion crossing the conveyance path in the thickness direction, and in the case where a sheet is present in the conveyance path, the optical path from the first light-passing portion to the second light-passing portion crossing the conveyance path in the thickness direction is blocked by the sheet. That is, in the case where a sheet is present in the conveyance path, the amount of light incident on the light-receiving element is configured to be smaller than in the case where no sheet is present in the conveyance path.

Factors for Degradation of Detection Accuracy

However, in actual conditions, sometimes the amount of light that reaches the light-receiving portion 35 in the state in which no sheet is present in the conveyance path might decrease due to condensation on the optical path and decrease in the amount of light emission of the LED serving as the light-emitting portion 33 depending on the accumulated light emission time and heat. In addition, although the attenuation of the light is smaller than in the first embodiment because the optical path length is shorter than in the first embodiment and the optical path has a linear shape, the light still attenuates in the optical path to the light-receiving portion 35 due to absorption, scattering, and the like by the members constituting the optical path.

Figure 12:
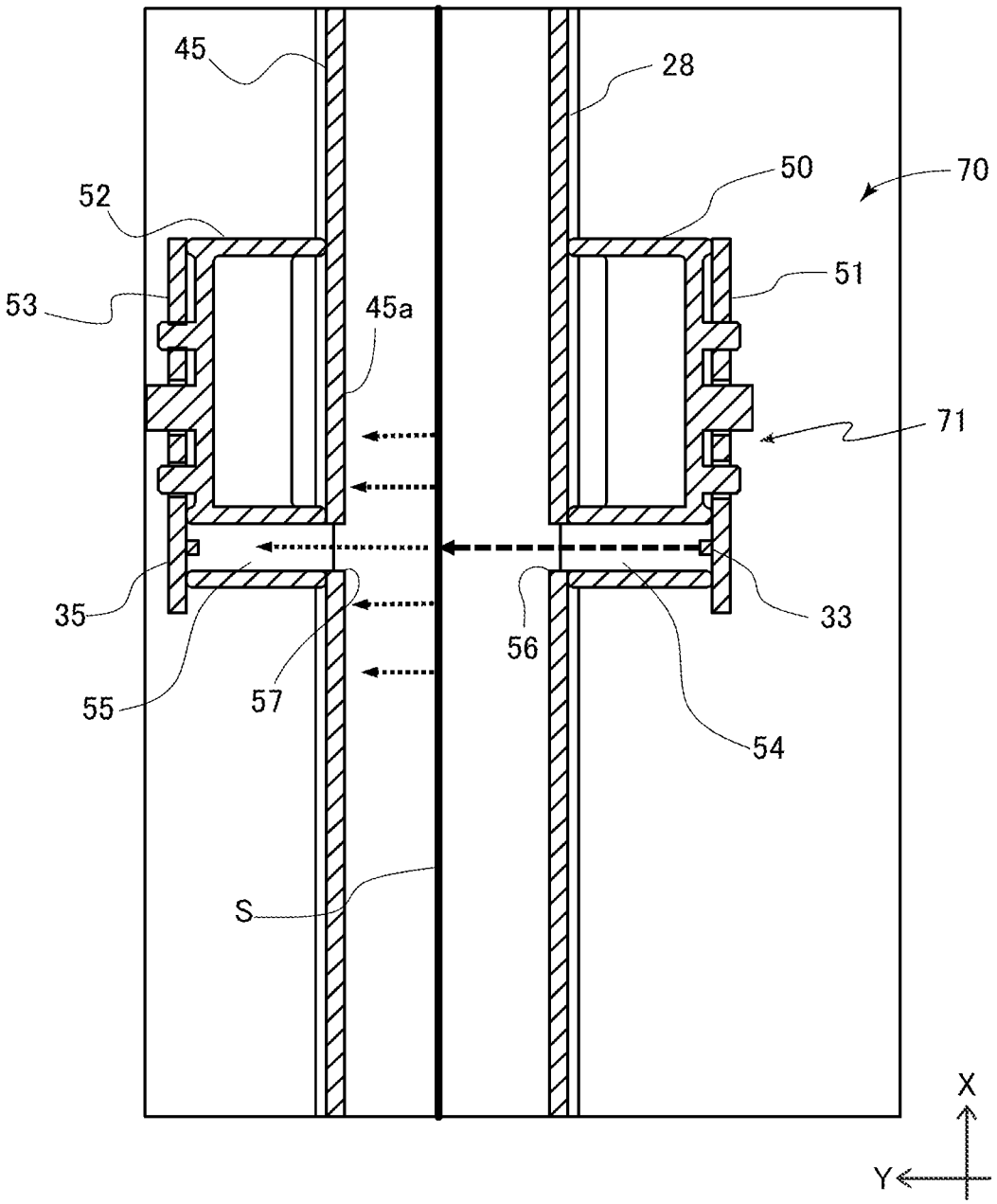
FIG. 12 is a diagram for describing an influence of transmitted light in the second embodiment.

In contrast, in the case where a sheet S is in the conveyance path, actually the sheet S slightly transmits the light and scatters the light as illustrated in FIG. 12. As a result, the light transmitted through the sheet S might directly reach the light-receiving portion 35, and light transmitted through and scattered in the sheet S might reach the light-receiving portion 35 as stray light after diffuse reflection between the sheet S and mainly the second conveyance guide 45. That is, even in the state in which the sheet S is present, part of the light might reach the light-receiving portion 35, thus a current might flow in the light-receiving portion 35, and the output voltage of the phototransistor might be lowered. Further, in the case of a sheet S of a recent type that is thin and likely to transmit light, more light reaches the light-receiving portion 35, and the output voltage is further lowered. As described above, also in the sheet detection mechanism 70 of the present embodiment, when disadvantageous conditions are piled up, there is a possibility that the margin between the output voltage of the light-receiving portion 35 and the threshold value of the output voltage corresponding to the presence or absence of the sheet in the conveyance path becomes smaller, and erroneous detection becomes more likely to occur.

Therefore, also in the present embodiment, the reflectance of each of the first light guidance portion 54 and the second light guidance portion 55 to the light emitted from the light-emitting portion 33 is configured to be higher than the reflectance of the guide unit including the first conveyance guide 28 and the second conveyance guide 45 to the light emitted from the light-emitting portion 33.

Specifically, an aluminum foil tape is stuck on at least part of the surface of the first light guidance portion 54 and the second light guidance portion 55 constituting the optical path, that is, the inner surface of the tubular shapes serving as light guidance surface. In addition, the second conveyance guide 45 is formed from black resin, and further a paint having high light absorbance is applied thereon. For example, the paint having high light absorbance is a paint that has absorbance of 99% or more for light in a wide wavelength band.

By setting the reflectance of each of the first light guidance portion 54 and the second light guidance portion 55 to be high, attenuation of the light emitted from the light-emitting portion 33 in the first light guidance portion 54 and the second light guidance portion 55 in the case where no sheet is present in the conveyance path can be suppressed. The reflectance of the aluminum foil tape is about 70%, which is higher than the reflectance of the mirror-finished white resin that is 4%, and thus decrease of the light amount can be suppressed more than in the first embodiment. Further, since the optical path length is smaller and the optical path is linear, the amount of light that reaches the light-receiving portion 35 can be more easily increased than in the first embodiment.

In contrast, by setting the reflectance of the second conveyance guide 45 to be low, the amount of light transmitted through and scattered in the sheet and reaching the light-receiving portion 35 as stray light after diffuse reflection between the sheet S and the second conveyance guide 45 in the case where a sheet is present in the conveyance path can be reduced.

As a result, the amount of change in the amount of light that reaches the light-receiving portion 35 according to the presence or absence of the sheet increases, and the amount of change in the output voltage of the light-receiving portion 35 increases. Therefore, it becomes easier to secure a sufficient margin between the output voltage of the light-receiving portion 35 corresponding to the presence or absence of the sheet and the threshold value P set in advance by the controller 1C, and thus the possibility of erroneous detection can be lowered and the detection accuracy can be maintained even under relatively disadvantageous conditions. Further, even in the case where the amount of light emission from the LED serving as the light-emitting portion 33 has decreased, big decrease in the amount of light received by the light-receiving portion 35 can be suppressed, and the lifetime of the sheet detection mechanism 70 and the image forming apparatus 1 can be set to be long while maintaining the detection accuracy of the sheet detection mechanism 70.

To be noted, as described in the first embodiment, the configuration for setting the reflectance to the light emitted from the light-emitting portion 33 to be high or low can be appropriately modified as long as the reflectance of each of the first light guidance portion 54 and the second light guidance portion 55 is higher than the reflectance of the second conveyance guide 45. The reflectance of each of the first light guidance portion 54 and the second light guidance portion 55 is preferably 3% or more, and more preferably 4% or more, and the reflectance of the second conveyance guide 45 is preferably 1.5% or less, and more preferably 1% or less. The value of the reflectance of the first light guidance portion 54 and the value of the reflectance of the second light guidance portion 55 may be different from each other.

In addition, although the paint having high light absorbance is applied on the entirety of the guide surface 45*a* of the second conveyance guide 45 in the present embodiment, a configuration in which the paint is applied on only a region that largely contributes to the stray light finally reaching the light-receiving portion 35 may be employed. The region that largely contributes to stray light is, for example, a peripheral portion of the second opening portion 57 of the guide surface 45*a* illustrated in FIG. 12. Therefore, the reflectance of each of the first light guidance portion 54 and the second light guidance portion 55 may be of any value as long as the reflectance is at least higher than the reflectance of the peripheral portion of the second opening portion 57 of the guide surface 45*a* in the second conveyance guide 45 serving as a guide member.

Third Embodiment

Next, a third embodiment will be described with reference to drawings. In the present embodiment, a configuration in which the light-receiving portion detects reflection light from a sheet in the case where the sheet is present in the conveyance path is used. In the description below, it is assumed that elements denoted by the same reference signs as in the first embodiment have substantially the same configuration and effects as in the first embodiment, and parts different from the first embodiment will be described.

Basic Configuration of Sheet Detection Mechanism

Figure 13A:
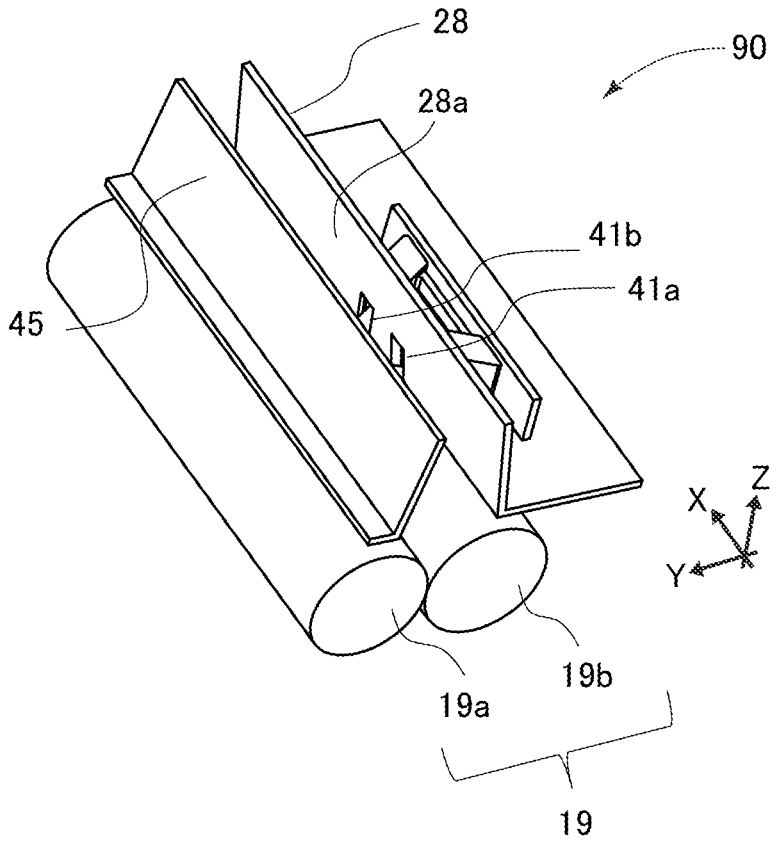
FIGS. 13A and 13B are each a perspective view of a sheet detection mechanism according to a third embodiment.
Figure 13B:
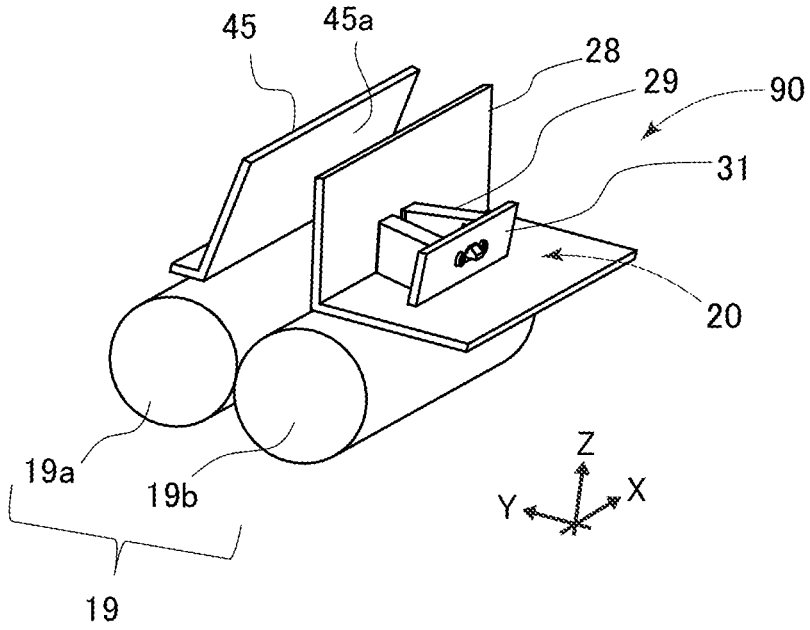
Figure 14A:
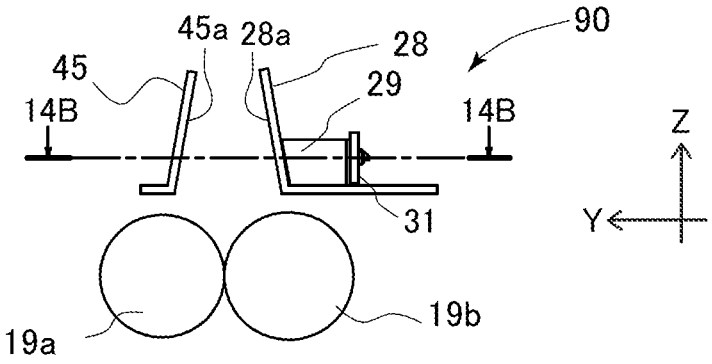
FIG. 14A is a side view of the sheet detection mechanism according to the third embodiment.
Figure 14B:
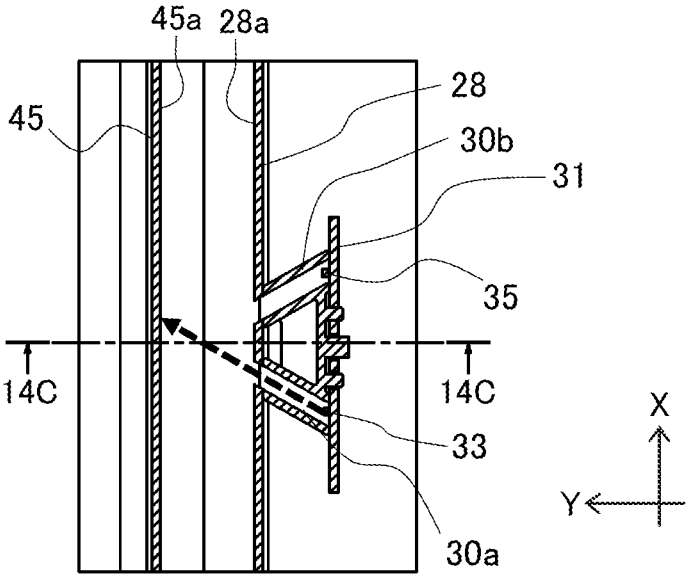
FIGS. 14B and 14C are each a section view of the sheet detection mechanism according to the third embodiment.
Figure 14C:
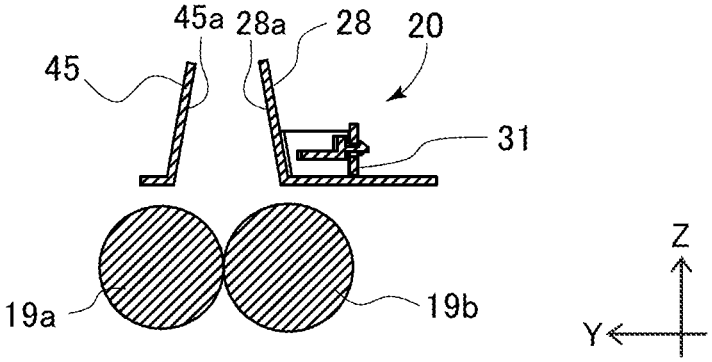

A basic configuration of a sheet detection mechanism 90 according to the present embodiment will be described. FIGS. 13A and 13B are each a perspective view of the sheet detection mechanism 90 according to the present embodiment. FIG. 14A is a side view of the sheet detection mechanism 90 as viewed in the sheet width direction X. FIG. 14B is a section view of the sheet detection mechanism 90 taken along a virtual plane along one of optical paths of the sheet detection mechanism 90 indicated by a line 14B-14B in FIG. 14A. In the present embodiment, the virtual plane is perpendicular to the conveyance direction Z. FIG. 14C is a section view of the sheet detection mechanism 90 taken along a virtual plane perpendicular to the sheet width direction X indicated by a line 14C-14C in FIG. 14B as viewed in the sheet width direction X.

In the present embodiment, unlike the first embodiment, no reflection member is provided on the second conveyance guide 45. In addition, unlike the first embodiment, the first light guidance portion 30*a* and the second light guidance portion 30*b* are provided such that a virtual line that is an extension of the center axis of the first light guidance portion 30*a* and a virtual line that is an extension of the center axis of the second light guidance portion 30*b* cross each other at a point inside the conveyance path. The other elements of the sensor unit 20 are substantially the same as in the first embodiment.

Detection Operation

Next, a sheet detection operation by the sheet detection mechanism 90 will be described. FIG. 14B illustrates the sheet detection mechanism 90 in which no sheet is present in the conveyance path. In the state in which no sheet is present, the light from the light-emitting portion 33 reaches the guide surface 45*a* of the second conveyance guide 45 after passing through the first light guidance portion 30*a*, but since no reflection member is provided on the guide surface 45*a*, the light is not mainly reflected toward the light-receiving portion 35. Further, since hardly any light reaches the light-receiving portion 35, a current does not flow in the phototransistor of the light-receiving portion 35, and the output voltage is not lowered. The controller 1C determines a state in which the output voltage of the light-receiving portion 35 is not lowered and is higher than the threshold value P set in advance as the state in which the sheet S is not present.

Figure 15A:
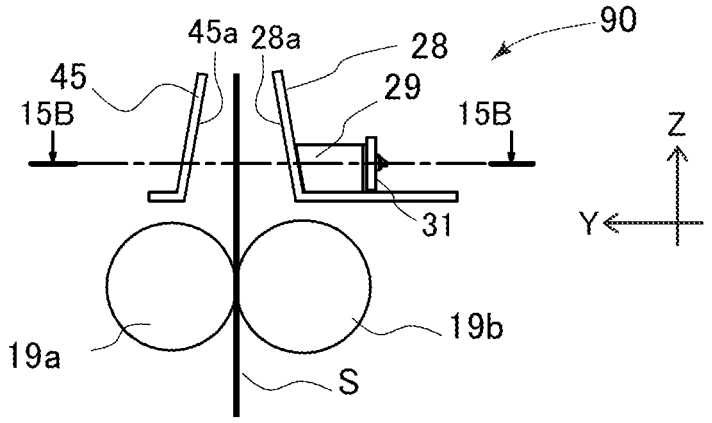
FIGS. 15A and 15B are each a diagram for describing an operation of the sheet detection mechanism according to the third embodiment.
Figure 15B:
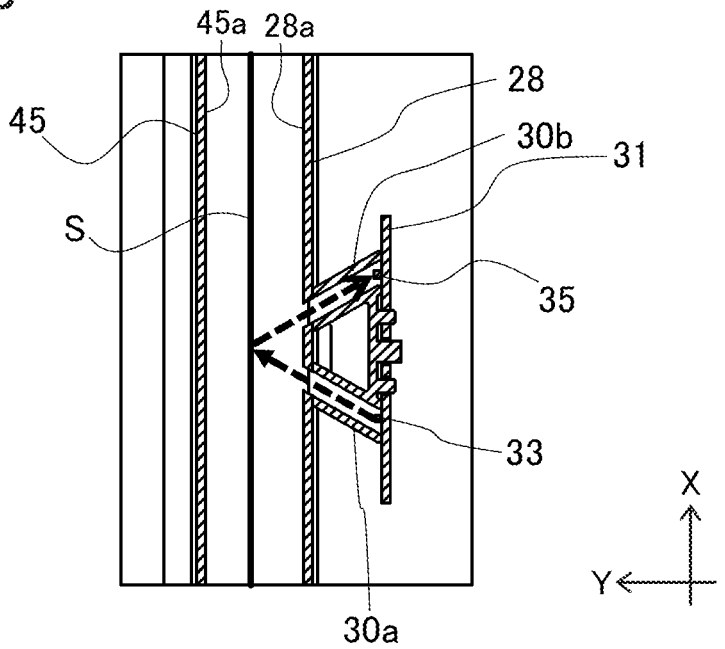

FIGS. 15A and 15B illustrate the sheet detection mechanism 90 in a state in which a sheet S is present in the conveyance path. FIG. 15A is a side view of the sheet detection mechanism 90 as viewed in the sheet width direction X. FIG. 15B is a section view of the sheet detection mechanism 90 taken along a line 15B-15B in FIG. 15A indicating a virtual plane along one of optical paths of the sheet detection mechanism 90. In the present embodiment, FIG. 15B is a section view taken along a virtual plane perpendicular to the conveyance direction Z.

In the case where a sheet S is present in the conveyance path, the light emitted from the light-emitting portion 33 and radiated into the conveyance path through the first light guidance portion 30*a* is reflected by the sheet S, and is incident on the light-receiving portion 35 through the second light guidance portion 30*b*. As a result, it becomes easier for a current to flow in the phototransistor of the light-receiving portion 35, and the output voltage is lowered. In the present embodiment, the controller 1C determines a state in which the output voltage of the light-receiving portion 35 is lower than the threshold value P as a state in which the sheet S is present.

In other words, the sheet detection mechanism 90 of the present embodiment has a diffuse reflection-type configuration in which a light-emitting element, a first light-passing portion, a light-receiving element, and a second light-passing portion are disposed on one side of the conveyance path in the thickness direction Y. Further, in the case where a sheet is present in the conveyance path, the light emitted from the light-emitting element reaches the light-receiving element through the optical path from the first light-passing portion to the second light-passing portion via reflection on the surface of the sheet. In the case where no sheet is present in the conveyance path, the optical path from the first light-passing portion to the second light-passing portion via reflection on the surface of the sheet is not formed. That is, in the case where a sheet is present in the conveyance path, the amount of light incident on the light-receiving element is configured to be larger than in the case where no sheet is present in the conveyance path.

However, in actual conditions, sometimes the amount of light that reaches the light-receiving portion 35 in the state in which a sheet is present in the conveyance path might decrease due to condensation on a member in the optical path and decrease in the amount of light emission of the LED serving as the light-emitting portion 33 depending on the accumulated light emission time and heat as described in the first embodiment. In addition, in the present embodiment, since the light is reflected by the sheet toward the light-receiving portion 35, the amount of light that reaches the light-receiving portion 35 is smaller than in the first embodiment in which the reflection plate 44 having a higher reflectance is used. In addition, the amount of light that reaches the light-receiving portion 35 can be smaller depending on the material of the sheet. Further, the amount of light that reaches the light-receiving portion 35 changes in accordance with the inclination and warpage of the sheet surface in the conveyance path.

Figure 16:
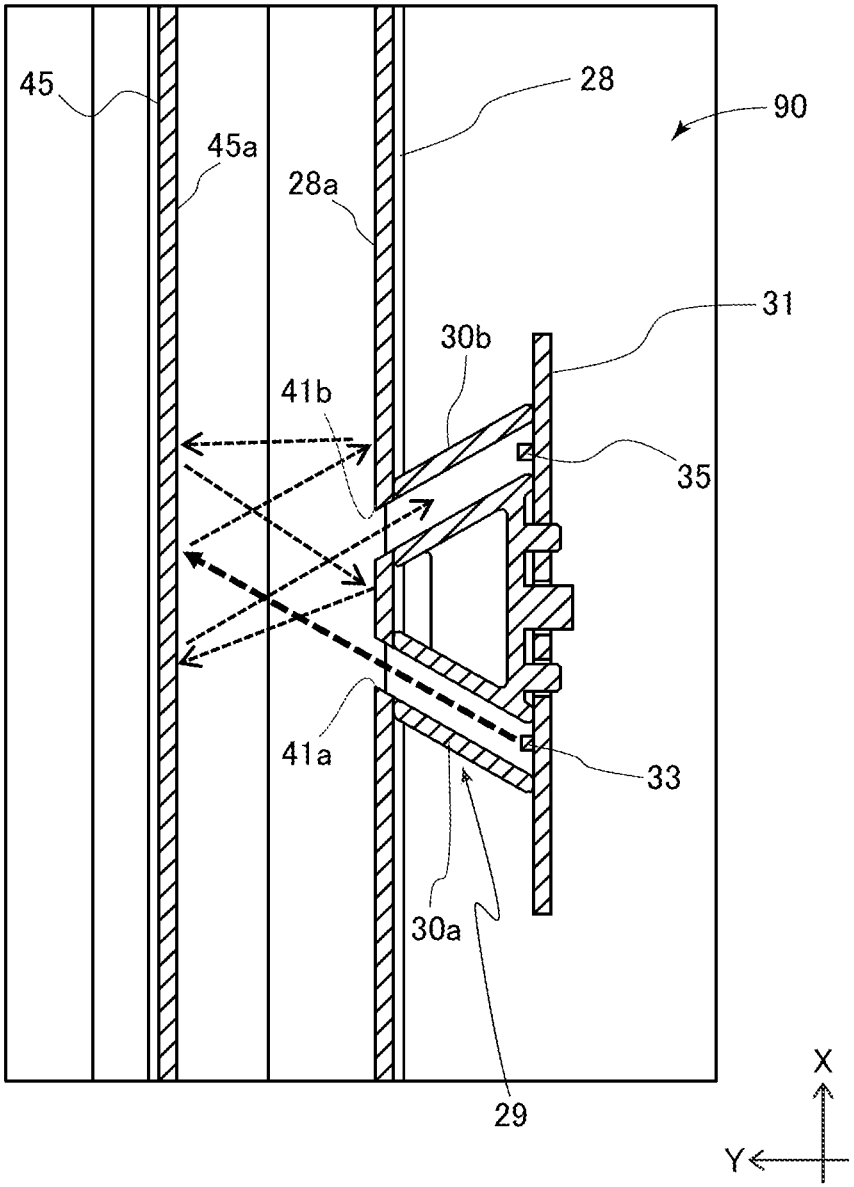
FIG. 16 is a diagram for describing an influence of diffuse reflection light in the third embodiment.

Meanwhile, in the case where the sheet S is not present, actually the second conveyance guide 45 slightly reflects the light. The light reflected by the second conveyance guide 45 is reflected between the second conveyance guide 45 and the first conveyance guide 28 by diffuse reflection as illustrated in FIG. 16, and when part of the reflected light reaches the light-receiving portion 35 as stray light, there is a possibility that a current flows in the light-receiving portion 35, and the output voltage of the light-receiving portion 35 is lowered.

Therefore, also in the present embodiment, the reflectance of each of the first light guidance portion 30*a* and the second light guidance portion 30*b* to the light emitted from the light-emitting portion 33 is configured to be higher than the reflectance of the guide unit to the light emitted from the light-emitting portion 33. Specifically, the surface of the first light guidance portion 30*a* and the second light guidance portion 30*b* constituting the optical path, that is, the inner surface of the tubular shapes serving as light guidance surface is formed from white resin or mirror-finished, a metal tape is stuck thereon, a paint containing metal is applied thereon, or a metal layer is formed thereon by vapor deposition or the like. In addition, the guide surfaces 28*a* and 45*a* of the first conveyance guide 28 and the second conveyance guide 45 are formed from black resin or matte-finished, or a paint having high light absorbance is applied thereon.

To be noted, the reflectance of each of the first light guidance portion 30*a* and the second light guidance portion 30*b* is preferably 3% or more, and more preferably 4% or more. The reflectance of each of the first conveyance guide 28 and the second conveyance guide 45 is preferably 1.5% or less, and more preferably 1% or less. The value of the reflectance of the first light guidance portion 30*a* and the value of the reflectance of the second light guidance portion 30*b* may be different from each other.

In addition, although the reflectance of the entirety of the guide surfaces 28*a* and 45*a* of the first conveyance guide 28 and the second conveyance guide 45 is configured to be low in the present embodiment, a configuration in which the reflectance is reduced in only a region that largely contributes to the stray light finally reaching the light-receiving portion 35 may be employed. The region that largely contributes to stray light is, for example, a peripheral portion of the first opening portion 41*a* and the second opening portion 41*b* of the guide surface 28*a* illustrated in FIG. 16 and portions of the guide surface 45*a* opposing the first opening portion 41*a* and the second opening portion 41*b*. Therefore, the reflectance of each of the first light guidance portion 30*a* and the second light guidance portion 30*b* may be of any value as long as the reflectance is at least higher than the reflectance of the peripheral portion of the first opening portion 41*a* and the second opening portion 41*b* of the guide surface 28*a* and the portion of the guide surface 45*a* opposing the first opening portion 41*a* and the second opening portion 41*b* in the first conveyance guide 28 and the second conveyance guide 45 serving as guide members.

By setting the reflectance of each of the first light guidance portion 30*a* and the second light guidance portion 30*b* to be high, attenuation of the light emitted from the light-emitting portion 33 in the first light guidance portion 30*a* and the second light guidance portion 30*b* in the case where a sheet is present in the conveyance path can be suppressed. Therefore, the amount of light that is reflected by the sheet and reaches the light-receiving portion 35 can be increased.

In contrast, by setting the reflectance of the first conveyance guide 28 and the second conveyance guide 45 to be low, the amount of light reaching the light-receiving portion 35 as stray light after diffuse reflection between the first conveyance guide 28 and the second conveyance guide 45 in the case where no sheet is present in the conveyance path can be reduced.

As a result, the amount of change in the amount of light that reaches the light-receiving portion 35 according to the presence or absence of the sheet increases, and the amount of change in the output voltage of the light-receiving portion 35 increases. Therefore, it becomes easier to secure a sufficient margin between the output voltage of the light-receiving portion 35 corresponding to the presence or absence of the sheet and the threshold value P set in advance by the controller 1C, and thus the possibility of erroneous detection can be lowered and the detection accuracy can be maintained even under relatively disadvantageous conditions. Further, even in the case where the amount of light emission from the LED serving as the light-emitting portion 33 has decreased, big decrease in the amount of light received by the light-receiving portion 35 can be suppressed, and the lifetime of the sheet detection mechanism 90 and the image forming apparatus 1 can be set to be longer while maintaining the detection accuracy of the sheet detection mechanism 90.

Other Embodiments

Although an image forming apparatus including a sheet detection mechanism that detects a sheet delivered out from the fixing unit 18 has been described as an example of a sheet conveyance apparatus in the first to third embodiments described above, the present technique can be also applied to other parts of the image forming apparatus or to other sheet conveyance apparatuses. For example, in the image forming apparatus 1 illustrated in FIG. 1, a sheet detection mechanism having the same configuration as that of one of the first to third embodiments may be disposed between the feed roller 24 and the registration roller pair 17. Examples of the "other sheet conveyance apparatuses" include a sheet processing apparatus that performs processing such as a binding process on sheets received from the image forming apparatus, and an auto document feeder that conveys a sheet serving as a document toward an image sensor for reading image information from the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-123703, filed on Jul. 20, 2020, which is hereby incorporated by reference herein in its entirety.

What is claimed is:

1. A sheet conveyance apparatus comprising:

a conveyance unit configured to convey a sheet;

a guide member disposed to define a conveyance path through which a sheet is conveyed;

a light-emitting element configured to emit light;

a light-receiving element configured to output a detection signal that changes in accordance with an amount of received light;

a first light-passing portion disposed to define an optical path from the light-emitting element to the conveyance path; and a second light-passing portion disposed to define an optical path from the conveyance path to the light-receiving element, wherein the light-receiving element is configured such that the detection signal changes in accordance with whether or not a sheet is present in the conveyance path, and wherein reflectance of each of the first light-passing portion and the second light-passing portion to the light emitted from the light-emitting element is higher than reflectance of the guide member to the light emitted from the light-emitting element.

2. The sheet conveyance apparatus according to claim 1, wherein the light-emitting element, the light-receiving element, the first light-passing portion, and the second light-passing portion are disposed on a first side of the conveyance path in a thickness direction of a sheet passing through the conveyance path, wherein the sheet conveyance apparatus further comprises a reflection member disposed on a second side opposite to the first side of the conveyance path in the thickness direction and configured to reflect, toward the second light-passing portion, light radiated into the conveyance path from the first light-passing portion, wherein in a case where no sheet is present in the conveyance path, the light emitted from the light-emitting element reaches the light-receiving element through an optical path from the first light-passing portion to the second light-passing portion via the reflection member, and wherein in a case where a sheet is present in the conveyance path, the optical path from the first light-passing portion to the second light-passing portion via the reflection member is blocked by the sheet present in the conveyance path.

3. The sheet conveyance apparatus according to claim 1, wherein the light-emitting element and the first light-passing portion are disposed on a first side of the conveyance path in a thickness direction of a sheet passing through the conveyance path, wherein the light-receiving element and the second light-passing portion are disposed on a second side opposite to the first side of the conveyance path in the thickness direction, wherein in a case where no sheet is present in the conveyance path, the light emitted from the light-emitting element reaches the light-receiving element through an optical path crossing the conveyance path in the thickness direction from the first light-passing portion to the second light-passing portion, and wherein in a case where a sheet is present in the conveyance path, the optical path crossing the conveyance path in the thickness direction from the first light-passing portion to the second light-passing portion is blocked by the sheet present in the conveyance path.

4. The sheet conveyance apparatus according to claim 1, wherein the light-emitting element, the light-receiving element, the first light-passing portion, and the second light-passing portion are disposed on one side of the conveyance path in a thickness direction of a sheet passing through the conveyance path, wherein in a case where a sheet is present in the conveyance path, the light emitted from the light-emitting element reaches the light-receiving element through an optical path from the first light-passing portion to the second light-passing portion via reflection on a surface of the sheet present in the conveyance path, and wherein in a case where no sheet is present in the conveyance path, the optical path from the first light-passing portion to the second light-passing portion via reflection on the surface of the sheet present in the conveyance path is not formed.

5. The sheet conveyance apparatus according to claim 1, wherein the first light-passing portion and the second light-passing portion are each formed from white resin.

6. The sheet conveyance apparatus according to claim 1, wherein the first light-passing portion and the second light-passing portion are each formed from a metal material.

7. The sheet conveyance apparatus according to claim 1, wherein a surface of each of the first light-passing portion and a surface of the second light-passing portion are each mirror-finished.

8. The sheet conveyance apparatus according to claim 1, wherein a metal layer is formed on a surface of each of the first light-passing portion and the second light-passing portion.

9. The sheet conveyance apparatus according to claim 1, wherein a metal tape is stuck on a surface of each of the first light-passing portion and the second light-passing portion.

10. The sheet conveyance apparatus according to claim 1, wherein a paint containing metal is applied on a surface of each of the first light-passing portion and the second light-passing portion.

11. The sheet conveyance apparatus according to claim 1, wherein the guide member is formed from black resin.

12. The sheet conveyance apparatus according to claim 1, wherein a surface of the guide member is matte-finished.

13. The sheet conveyance apparatus according to claim 1, wherein a paint having absorbance of 99% or higher for the light emitted from the light-emitting element is applied on a surface of the guide member.

14. The sheet conveyance apparatus according to claim 1, wherein reflectance of each of the first light-passing portion and the second light-passing portion to the light emitted from the light-emitting element is 3% or more, and wherein reflectance of the guide member to the light emitted from the light-emitting element is 1.5% or less.

15. The sheet conveyance apparatus according to claim 1, wherein reflectance of each of the first light-passing portion and the second light-passing portion to the light emitted from the light-emitting element is 4% or more, and wherein reflectance of the guide member to the light emitted from the light-emitting element is 1% or less.

16. The sheet conveyance apparatus according to claim 1, wherein the light-emitting element is a light-emitting diode.

17. The sheet conveyance apparatus according to claim 1, wherein the first light-passing portion constitutes at least part of an inner surface of a tubular shape having a first opening end and a second opening end, the first opening end opposing a substrate on which the light-emitting element is provided, the second opening end communicating with the conveyance path, wherein the second light-passing portion constitutes at least part of an inner surface of a tubular shape having a third opening end and a fourth opening end, the third opening end opposing a substrate on which the light-receiving element is provided, the fourth opening end communicating with the conveyance path, and wherein reflectance of each of the inner surface of the tubular shape constituted by the first light-passing portion and the inner surface of the tubular shape constituted by the second light-passing portion to the light emitted by the light-emitting element is higher than the reflectance of the guide member to the light emitted by the light-emitting element.

18. An image forming apparatus comprising:

an image forming portion configured to form an image on a sheet; and the sheet conveyance apparatus according to claim 1 configured to convey a sheet.

19. The image forming apparatus according to claim 18, wherein the conveyance unit comprises a fixing unit, the fixing unit comprising a rotary member pair configured to nip a sheet and rotate, and a heating portion configured to heat a nip portion of the rotary member pair, wherein the fixing unit is configured to heat a toner image while conveying a sheet, on which the toner image has been formed by the image forming portion, by the rotary member pair to fix the toner image to the sheet bearing the toner image, and wherein the light-emitting element, the light-receiving element, the first light-passing portion, and the second light-passing portion are arranged such that the detection signal changes in accordance with whether or not there is a sheet being delivered out from the nip portion toward the conveyance path.

* * * * *